US006616415B1

(12) United States Patent
Renken et al.

(10) Patent No.: US 6,616,415 B1
(45) Date of Patent: Sep. 9, 2003

(54) FUEL GAS COMPRESSION SYSTEM

(75) Inventors: Troy W. Renken, Troy, OH (US); Phil Langhorst, Crestwood, MO (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 10/106,652

(22) Filed: Mar. 26, 2002

(51) Int. Cl.[7] ..... F04B 49/06
(52) U.S. Cl. ..... 417/44.1; 318/433
(58) Field of Search ..... 417/26, 44.1; 60/277, 60/676; 62/228, 210; 290/52; 318/803, 433; 307/10.6; 388/934; 236/10

(56) References Cited

U.S. PATENT DOCUMENTS 4,353,220 A * 10/1982 Curwen et al. ..... 62/228
4,421,268 A * 12/1983 Bassett et al. ..... 236/10
5,123,080 A * 6/1992 Gillett et al. ..... 388/934
5,125,067 A * 6/1992 Erdman ..... 388/934
5,126,642 A * 6/1992 Shahrodi ..... 318/433
5,272,428 A * 12/1993 Spiegel et al. ..... 318/803
5,272,879 A * 12/1993 Wiggs ..... 60/676
5,765,380 A * 6/1998 Misawa et al. ..... 62/210
6,066,898 A * 5/2000 Jensen ..... 290/52
6,198,174 B1 * 3/2001 Nims et al. ..... 290/52
6,396,165 B1 * 5/2002 Nagano et al. ..... 307/10.6
6,461,112 B1 * 10/2002 Ohta et al. ..... 417/26
2001/0037642 A1 * 11/2001 Uchida ..... 60/277

* cited by examiner

*Primary Examiner*—Teresa Walberg
*Assistant Examiner*—L Fastovsky
(74) *Attorney, Agent, or Firm*—Harness, Dickey & Pierce, P.L.C.

(57) ABSTRACT

A fuel gas compression system includes a system which operates on direct current, a system which operates on alternating current and a system which is capable of operating on either direct current or alternating current. In the system that operates on either direct current or alternating current, a jumper is provided which is placed in the circuit when an alternating current is provided. When a direct current is provided, the jumper is removed from the circuit.

14 Claims, 13 Drawing Sheets

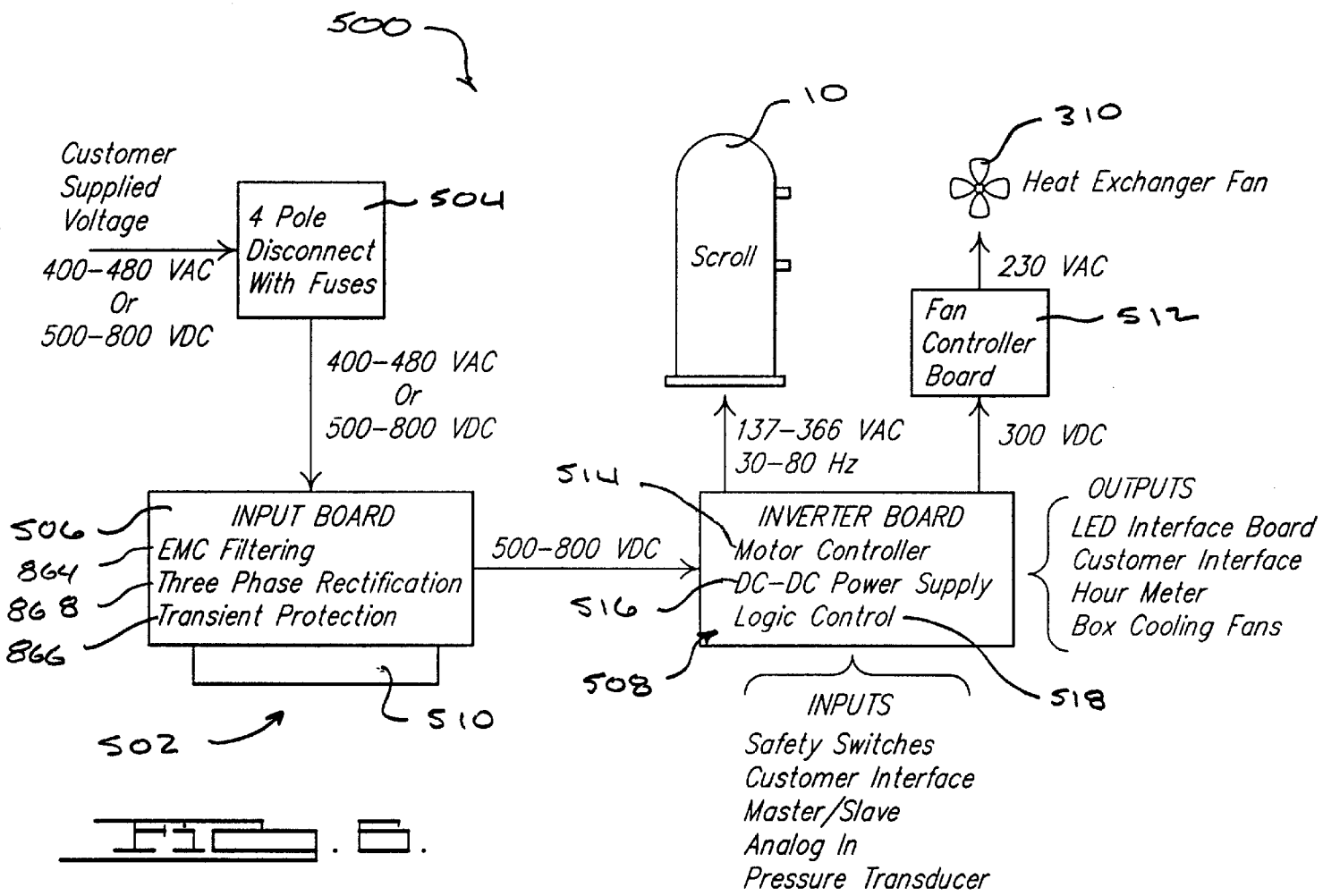
500
Customer Supplied Voltage
400–480 VAC Or 500–800 VDC
4 Pole Disconnect With Fuses
504
400–480 VAC Or 500–800 VDC
INPUT BOARD
EMC Filtering
Three Phase Rectification
Transient Protection
506
864
868
866
510
502
500–800 VDC
Scroll
10
137–366 VAC
30–80 Hz
INVERTER BOARD
Motor Controller
DC–DC Power Supply
Logic Control
514
516
508
INPUTS
Safety Switches
Customer Interface
Master/Slave
Analog In
Pressure Transducer
OUTPUTS
LED Interface Board
Customer Interface
Hour Meter
Box Cooling Fans
518
Fan Controller Board
512
300 VDC
230 VAC
Heat Exchanger Fan
310

FUEL GAS COMPRESSION SYSTEM

FIELD OF THE INVENTION

The present invention relates generally to scroll-type machinery. More particularly, the present invention relates to scroll-type machinery specifically adapted for use in the compression of fuel gas and the control system for the scroll-type machinery.

BACKGROUND AND SUMMARY OF THE INVENTION

Scroll machines are becoming more and more popular for use as compressors in refrigeration systems as well as air conditioning and heat pump applications due primarily to their capability for extremely efficient operation. Generally, these machines incorporate a pair of intermeshed spiral wraps, one of which is caused to orbit with respect to the other so as to define one or more moving chambers which progressively decrease in size as they travel from an outer suction port towards a center discharge port. An electric motor is normally provided which operates to drive the scroll members via a suitable drive shaft.

As the popularity of scroll machines increase, the developers of these scroll machines continue to adapt and redesign the scroll machines for compression systems outside the traditional refrigeration systems. Additional applications for scroll machines include helium compression for cryogenic applications, air compressors, fuel gas compressors for distributed power generation and the like. The present invention is directed towards a scroll machine which has been designed specifically for the compression of fuel gas and the control system which operates the compressor in order to supply compressed fuel gas for distributed power generation.

Distributed power generation has emerged in recent years as a means to provide on-site power generation for commercial and industrial customers seeking a degree of independence from the possibility of a power shortage or power loss. While previous distributed power generation equipment was designed primarily to address the need for backup power, today's products are focused on providing continuous reliable power at an attractive price. Specifically, today's distributed power generators are intended to continuously supply clean, quiet and reliable power for both grid parallel and stand alone applications.

One important vehicle for the emerging distributed power generation market is the microturbine power generators. This device, about the size of two refrigerators, contains a jet turbine engine capable of using multiple fuels including pressurized fuel gas. Inlet air is compressed in the centrifugal compressor section, mixed with pressurized fuel gas, and then combusted to drive a turbine and a generator on a common high-speed shaft with the compressor. The high frequency power is then rectified and converted to a useable 50/60-cycle three-phase power through the use of an onboard inverter. Single microturbine generators are currently sized for 30 to 100 kilowatts of power generation but may eventually service a 200 to 300 kilowatt load. Fuel sources for microturbines include pipeline quality natural gas and biogas from landfill and digester plants.

Another technology well suited for distributed power generation is a conventional diesel driven generator converted for use with pressurized fuel gas. In this application termed "dual fuel", a small percentage of diesel fuel is mixed with pressurized fuel gas to enhance the power generation output of the reciprocating engine. Low emissions are obtained relative to conventional diesel gensets, allowing this equipment to be used for continuous power generation versus the limited use operation allowed previously with emergency power applications. Dual fuel diesel gensets are being developed for power needs up to several megawatts.

An additional potential application option for the fuel gas compressor is a fuel cell using natural gas as the fuel. With this device pressurized natural gas flows through a reformer element which separates out hydrogen from the methane in the natural gas. The hydrogen fuel is then combined with pressurized air (oxygen) to provide the necessary ingredients for the electrochemical reaction that results in DC electric power.

To meet the need of these emerging power generation technologies for pressurized fuel gas, a reliable and efficient gas compression system was required to boost gas pressure at the site to the typical 60–100 psig operating pressure needed by the equipment. Normal variability in gas pressure and energy content, as well as the need for the power generator to operate at part load, required this gas compression system to efficiently supply a variable amount of fuel. This requirement is accomplished by the present invention through a custom variable speed electronic drive that also includes a microcompressor based logic control for use in fault and safety mode detection. Finally, to insure many years of reliable operation, a proven compressor technology, utilized in air conditioning and refrigeration products, was adapted to meet the specific needs of fuel gas compression.

The cyclic compression of fuel gas presents very unique problems with respect to compressor design because of the high temperatures encountered during the compression process. The temperature rise of fuel gas during the compression process can be more than twice the temperature rise encountered during the compression process of a conventional refrigerant. In order to prevent possible damage to the scroll machine from these high temperatures, it is necessary to provide additional cooling for the scroll machine in addition, fuel gas compression systems as well as other compression applications need to be capable of being powered from a variety of electrical sources. These electrical sources can be a direct current source or an alternating current source depending upon the particular application.

The present invention, in one embodiment, comprises a scroll compressor system which is specifically adapted for use in the compression of fuel gas. The scroll compressor of the system includes the conventional low pressure oil sump in the suction pressure zone of the compressor as well as a second high pressure oil sump located in the discharge pressure zone. An internal oil cooler is located within the low pressure oil sump. Oil from the low pressure oil sump is circulated to the bearings and other movable components of the compressor in a manner similar to that of conventional scroll compressors. A portion of the oil used to lubricate these moving components is pumped by a rotating component onto the windings of the electric motor to aid in cooling the motor. The oil in the high pressure oil sump is routed through an external heat exchanger for cooling and then is routed through the internal oil cooler located in the low pressure oil sump. From the internal oil cooler, the oil is injected into the compression pockets to aid in the cooling of the compressor as well as to assist in the sealing and lubrication of the intermeshed scroll wraps. An internal oil separator is provided in the discharge chamber to remove at least a portion of the injected oil from the compressed gas and thus replenish the high pressure oil sump. An oil overflow orifice prevents excessive accumulation of oil in the high pressure oil sump. A second external oil separator is associated with the external heat exchanger in order to remove additional oil from the natural gas to provide as close as possible for an oil free pressurized natural gas supply.

In another embodiment of the present invention, a unique scroll type compressor which is modified from proven air conditioning scroll compressor technology is provided for compressing the fuel gas. The compressor is a hermetic design which means both the motor and the scroll compression mechanism are in the same enclosure. This eliminates shaft seals and the possibility of gas leakage as is possible with open drive type compressors. Due to the high specific heat ratio and high compression temperatures inherent with fuel gas, the compression process is oil flooded to prevent overheating and insure compressor durability. Compressor durability is also enhanced by the lower outlet pressures of this application relative to the higher pressures typical in air conditioning applications. Both UL and CE approval have been obtained for this product.

The control system of the present invention allows the powering of the compressors by either a direct current (DC) source or an alternating current (AC) source. The system can be designed to be powered by only a DC source, only an AC source or it can be a "universal" compressor which can be powered by either a DC or an AC source.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 13 is a graph illustrating both output and input parameters as a function of variable flow.

DETAILED DESCRIPTION OF THE PREFERRED EMBODIMENT

Figure 1:
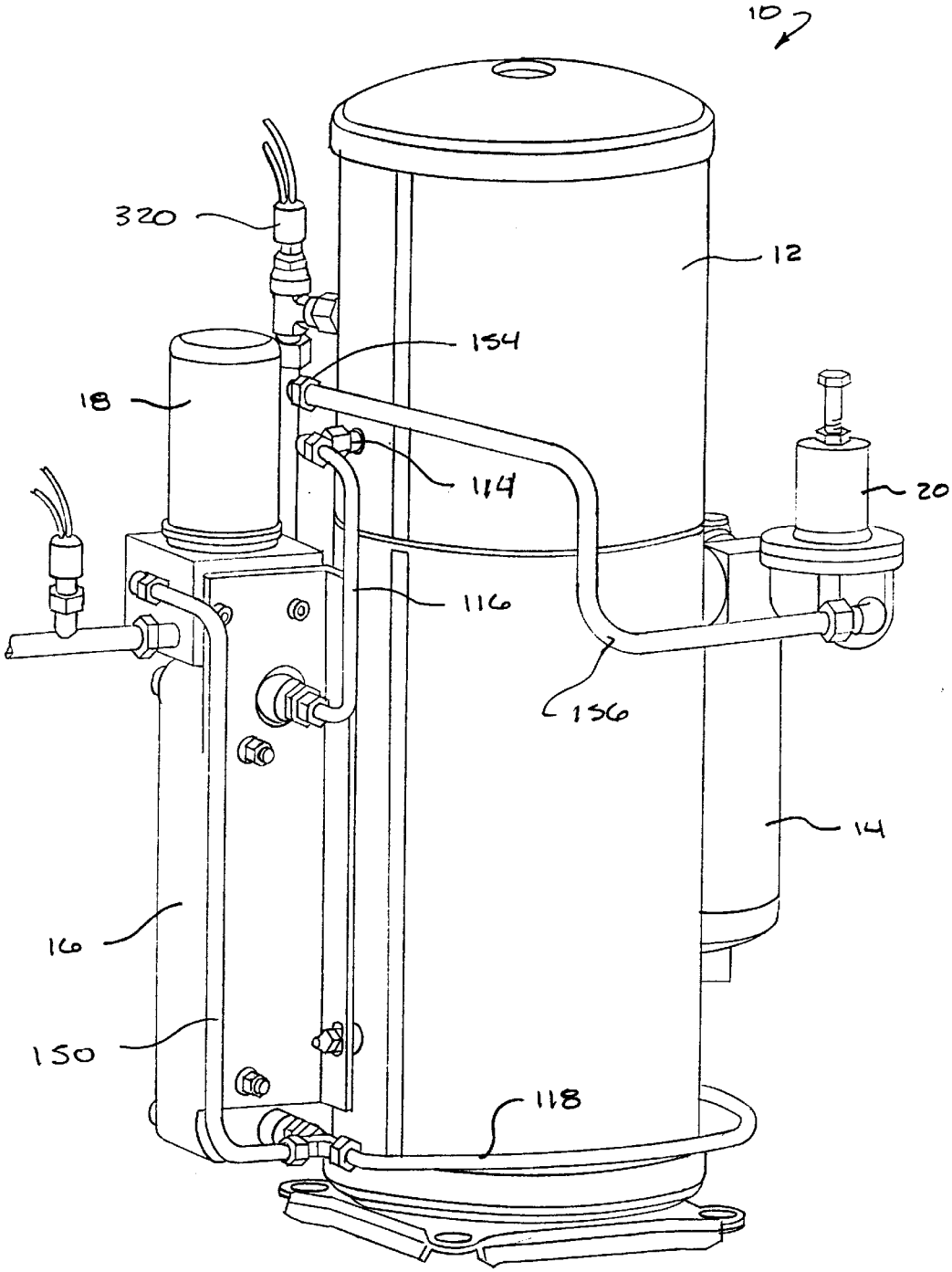
FIG. 1 is an external elevational view of a fuel gas compression system in accordance with the present invention.
Figure 2:
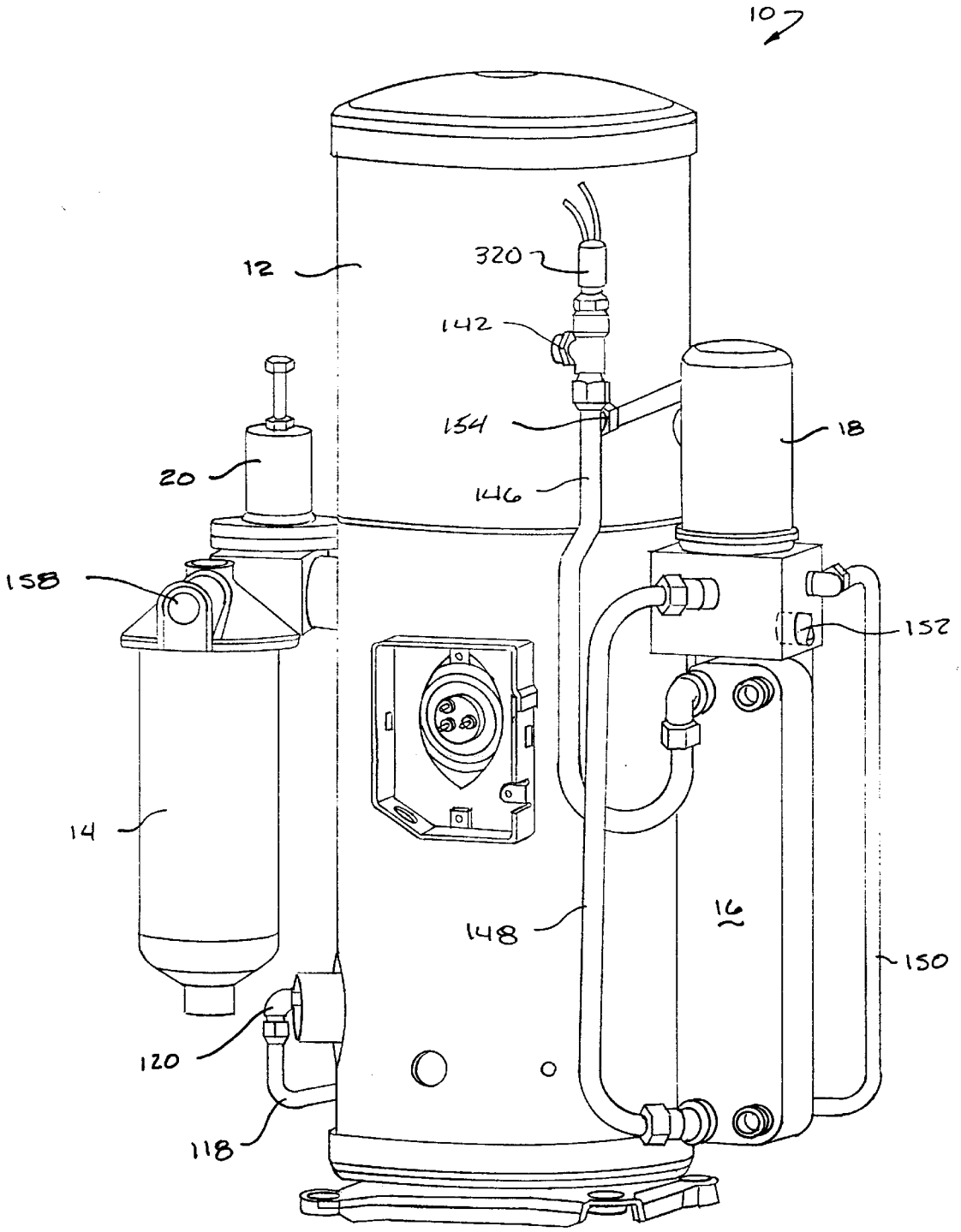
FIG. 2 is an external elevational view of the fuel gas compression system shown in FIG. 1 in a direction opposite to that shown in FIG. 1.

Referring now to the drawings in which like reference numerals designate like or corresponding parts throughout the several views, there is shown in FIGS. 1 and 2 a scroll machine in accordance with the present invention which is designated generally by the reference numeral 10. Scroll machine 10 comprises a scroll compressor 12, a filter 14, an external oil/gas cooler 16, an external oil separator 18 and a pressure regulator 20.

Figure 3:
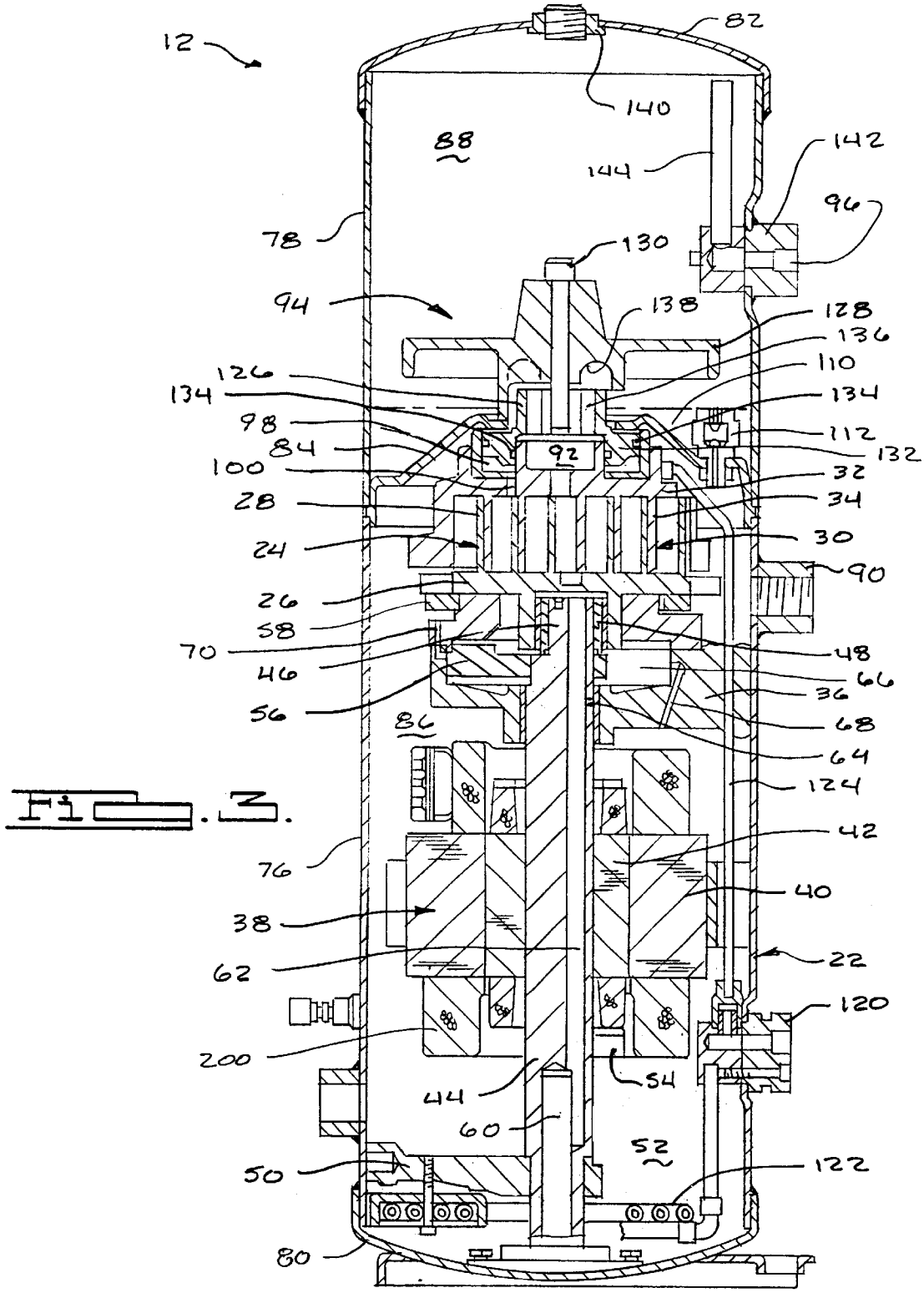
FIG. 3 is a vertical cross-sectional view of the compressor shown in FIGS. 1 and 2.

Referring to FIG. 3, compressor 12 includes an outer shell 22 within which is disposed a compressor assembly including an orbiting scroll member 24 having an end plate 26 from which a spiral wrap 28 extends, a non-orbiting scroll member 30 having an end plate 32 from which a spiral wrap 34 extends and a two-piece main bearing housing 36 supportingly secured to outer shell 22. Main bearing housing 36 supports orbiting scroll member 24 and non-orbiting scroll member 30 is axially movably secured to main bearing housing 36. Wraps 28 and 34 are positioned in meshing engagement such that as orbiting scroll member 24 orbits, wraps 28 and 34 will define moving fluid pockets that decrease in size as they move from the radially outer region of scroll members 24 and 30 toward the center region of the scroll members.

A variable speed driving motor 38 is also provided in the lower portion of shell 22. Variable speed motor 38 includes a stator 40 supported by shell 22 and a rotor 42 secured to and drivingly connected to a drive shaft 44. Drive shaft 44 is drivingly connected to orbiting scroll member 24 via an eccentric pin 46 and a drive bushing 48. Drive shaft 44 is rotatably supported by main bearing housing 36 and a lower bearing housing 50 which is secured to shell 22. The lower end of drive shaft 44 extends into an oil sump 52 provided in the bottom of shell 22. A lower counterweight 54 and an upper counterweight 56 are supported on drive shaft 44. Counterweights 54 and 56 serve to balance the rotation of drive shaft 44 and counterweight 56 acts as an oil pump as described in greater detail below. In order to prevent orbiting scroll member 24 from rotating relative to non-orbiting scroll member 30, an Oldham coupling 58 is provided. Oldham coupling 58 is supported on main bearing housing 36 and interconnecting with both orbiting scroll member 24 and non-orbiting scroll member 30.

In order to supply lubricant from oil sump 52 to the bearings and other moving components of compressor 12, an oil pump is provided in the lower end of drive shaft 44 in the form of a large axial bore 60 which serves to direct oil axially upward through an eccentric axially extending passage 62. A radial passage 64 is provided to supply lubrication oil to main bearing housing 36. The oil that is pumped through passage 62 will be discharged from the top of eccentric pin 46 to lubricate the interface between drive bushing 48 and orbiting scroll member 24. After lubricating these interfaces, the oil accumulates within a chamber 66 defined by main bearing housing 36. Upper counterweight 56 rotates within chamber 66 and acts as a pump to pump oil through a passage 68 extending through main bearing housing 36. Passage 68 receives oil from chamber 66 and routes this oil to stator 40 to aid in the cooling of the motor. Upper counterweight 56 also pumps lubricating fluid up through a passage 70 also defined by main bearing housing 36. Passage 70 receives oil from chamber 66 and directs this oil up towards Oldham coupling 58, the lower surface of end plate 26 of orbiting scroll member 24 and into the suction port formed by scroll members 24 and 30.

Outer shell piece 22 includes a lower shell 76, an upper shell 78, a lower cover 80 and an upper cap 82. A partition or muffler plate 84 is also provided extending across the interior of shell 22 and is sealing secured thereto around its periphery at the same point that lower shell 76 is sealingly secured to upper shell 78. Muffler plate 84 serves to divide the interior of shell 22 into a lower suction chamber 86 and an upper discharge chamber 88.

In operation, suction gas will be drawn into suction chamber 86 through a suction inlet 90 and into the moving pockets defined by scroll wraps 28 and 34. As orbiting scroll member 24 orbits with respect to non-orbiting scroll member 30, the fluid pockets will move inwardly decreasing in size and thereby compressing the fluid. The compressed fluid will be discharged into discharge chamber 88 through a discharge port 92 provided in non-orbiting scroll member 30 and a discharge fitting assembly 94 secured to muffler plate 84. The compressed fluid then exits discharge chamber 88 through a discharge outlet 96. In order to maintain axially movable non-orbiting scroll member 30 in axial sealing engagement with orbiting scroll member 24, a pressure biasing chamber 98 is provided in the upper surface of non-orbiting scroll member 30. A portion of discharge fitting assembly 94 extends into non-orbiting scroll member 30 to define biasing chamber 98. Biasing chamber 98 is pressurized by fluid at an intermediate pressure between the pressure in the suction area and the pressure in the discharge area of compressor 12. One or more passages 100 supply the intermediate pressurized fluid to biasing chamber 98. Biasing chamber 98 is also pressurized by the oil which is injected into chamber 98 by the lubrication system as detailed below.

With the exception of discharge fitting assembly 94, compressor 12 as thus far described is similar to and incorporates features described in general detail in Assignee's U.S. Pat. No. 4,877,382; 5,156,539; 5,102,316; 5,320,506; and 5,320,507 the disclosures of which are hereby incorporated herein by reference.

As noted above, compressor 12 is specifically adapted for compressing fuel gas. The compression of fuel gas results in the generation of significantly higher temperatures. In order to prevent these temperatures from being excessive, it is necessary to incorporate various systems for cooling the compressor and the compressed fuel gas. In addition to the cooling for the compressor and the fuel gas, it is also very important that substantially all oil be removed from the compressed gas before it is supplied to the apparatus using the compressed fuel gas.

One system which is incorporated for the cooling of compressor 12 is the circulation of cooled lubricating oil. Upper shell 78 and muffler plate 84 define a sump 110 which is located within discharge chamber 88. The oil being supplied to the suction port formed by scroll members 24 and 30 through passage 70 continuously adds to the volume of oil within sump 110. An oil overflow fitting 112 extends through muffler plate 84. Fitting 112 has an oil over flow orifice which keeps the level of oil in sump 110 at the desired level. Oil in sump 110 is routed through an outlet fitting 114 (FIG. 1) extending through upper shell 78 and into oil/gas cooler 16 by a connecting tube 116. The cooled oil exits oil/gas cooler 16 through a connecting tube 118 and enters lower shell 76 through an inlet fitting 120 Oil entering fitting 120 is routed through a heat exchanger in the form of a cooling coil 122 which is submerged within oil sump 52. The oil circulates through cooling coil 122 cooling the oil in oil sump 52 and is returned to inlet fitting 120 Oil entering inlet fitting 120 from coil 122 is directed to biasing chamber 98 through a connecting tube 124. The oil enters biasing chamber 98 where it enters the compression chambers formed by wraps 28 and 34 through passages 100 to cool compressor 12 as well as assisting in the sealing and lubricating of wraps 28 and 34. The oil injected into the compression chambers is carried by the compressed gas and exits the compression chambers with the fuel gas through discharge port 92 and discharge fitting assembly 94.

Discharge fitting assembly 94 includes a lower seal fitting 126 and an upper oil separator 128 which are secured together sandwiching muffler plate 84 by a bolt 130. Lower seal fitting 126 sealingly engages and is located below muffler plate 84 and it includes an annular extension 132 which extends into non-orbiting scroll member 30 to close and define biasing chamber 98. A pair of seals 134 isolate biasing chamber 98 from both suction chamber 86 and discharge chamber 88. Lower seal fitting 126 defines a plurality of discharge passages 136 which receive compressed fuel gas from discharge port 92 and direct the flow of the compressed fuel gas towards oil separator 128 Oil separator 128 is disposed above muffler plate 84. Compressed fuel gas exiting discharge passages 136 contacts a lower contoured surface 138 of oil separator 128 and is redirected prior to entering discharge chamber 88. The contact between the compressed fuel gas and surface 138 causes the oil within the gas to separate and return to sump 110. During the assembly of compressor 12, lower seal fitting 126 and upper oil separator 128 are attached to muffler plate 84 by bolt 130. Bolt 130 is not tightened until the rest of the components of compressor 12 are assembled and secured in place. Once this has been accomplished, bolt 130 is tightened. Access to bolt 130 is provided by a fitting 140 extending through cap 82. Once bolt 130 is tightened, fitting 146 is sealed to isolate discharge chamber 88.

Compressed fuel gas exits discharge chamber 88 through discharge outlet 96. Discharge outlet 96 includes a discharge fitting 142 and an upstanding pipe 144. Discharge fitting 142 extends through upper shell 78 and upstanding pipe 144 extends toward cap 82 such that the compressed fuel gas adjacent cap 82 is directed out of discharge chamber 88. By accessing the compressed fuel gas located adjacent cap 82, the gas with the least amount of oil contained in the gas is selectively removed. Compressed fuel gas exiting discharge chamber 88 through discharge outlet 96 is routed to oil/gas cooler 16 through a connecting pipe 146. Oil/gas cooler 16 can be a liquid cooled cooler using Glycol or other liquids known in the art as the cooling medium or oil/gas cooler 16 can be a gas cooled cooler using air or other gases known in the art as the cooling medium if desired. The cooled compressed fuel gas exits oil/gas cooler 16 through a connecting pipe 148 and is routed to oil separator 18. Oil separator 18 removes substantially all of the remaining oil from the compressed gas. This removed oil is directed back into compressor 12 by a connecting tube 150 which connects oil separator 18 with connecting tube 118. The oil free compressed and cooled fuel gas leaves oil separator 18 through an outlet 152 to which the apparatus using the fuel gas is connected. An accumulator may be located between outlet 152 and the apparatus using the fuel gas if desired. A bypass fitting 154 is connected to connecting pipe 146 for routing the fuel gas to pressure regulator 20 by a connecting pipe 156. Pressure regulator 20 controls the outlet pressure of fuel gas at outlet 152 by controlling the pressure input to oil/gas cooler 16 through connecting pipe 146. Pressure regulator 20 is connected to filter 14 and filter 14 includes an inlet 158 to which is connected to the uncompressed source of fuel gas.

Thus, low pressure gas is piped to inlet 158 of filter 14 where it is supplied to suction inlet 90 and thus suction chamber 86 along with gas rerouted to suction inlet 90 and suction chamber 86 through pressure regulator 20. The gas in suction chamber 86 enters the moving pockets defined by wraps 28 and 34 where it is compressed and discharged through discharge port 92. During the compression of the gas, oil is mixed with the gas by being supplied to the compression chambers from biasing chamber 98 through passages 100. The compressed gas exiting discharge port 92 impinges upon upper oil separator 128 where a portion of the oil is removed from the gas prior to the gas entering discharge chamber 88. The gas exits discharge chamber 88 through discharge outlet 96 and is routed through oil/gas cooler 16 and then into oil separator 18. The remaining oil is separated from the gas by oil separator 18 prior to it being delivered to the appropriate apparatus through outlet 152. The pressure of the gas at outlet 152 is controlled by pressure regulator 20 which is connected to connecting pipe 156, connecting pipe 146 and to suction chamber 86.

In addition to the temperature problems associated with the compression of the fuel gas, there are problems associated with various components of or contaminants within the fuel gas such as hydrogen sulfide ($H_25$). All polyester based materials degrade and are thus not acceptable for use in any fuel gas application. One area which is of a particular concern is the individual components of motor stator 40.

Motor stator 40 includes a plurality of windings 200 which are typically manufactured from copper. For the compression of fuel gas, windings 200 are manufactured from aluminum in order to avoid the degradation of windings 200 from the fuel gas. In addition to the change of the material of the coil windings itself, the following table lists the other components of stator 40 which require revision in order to improve their performance when compressing fuel gas.

| Item | Current Material | Natural Gas Material |
|---|---|---|
| Varnish | PD George 923<br>PD George 423<br>Schenectady 800P | Guardian GRC-59 |
| Tie Cord | Dacron | Nomex<br>Cotton<br>Nylon treated w/ acrylic |
| Phase Insulation | Mylar | Nomex<br>Nomex-Kapton-Nomax |
| Slot Liner | Mylar | Nomex<br>Nomex-Kapton-Nomax |
| Soda Straw | Mylar | Teflon |

-continued

| Item | Current Material | Natural Gas Material |
|---|---|---|
| Lead Wire Insulation | Dacron and Mylar (DMD) | Hypalon |
| Lead Wire Tubing | Mylar | Teflon |
| Terminal Block | Valox 310 | Vitem 1000-7100<br>Fibcrite 400S-464B<br>Ultrason E2010G4 |

The above modification for the materials reduces and/or eliminates degradation of these components when they are utilized for compressing fuel gas.

Figure 4:
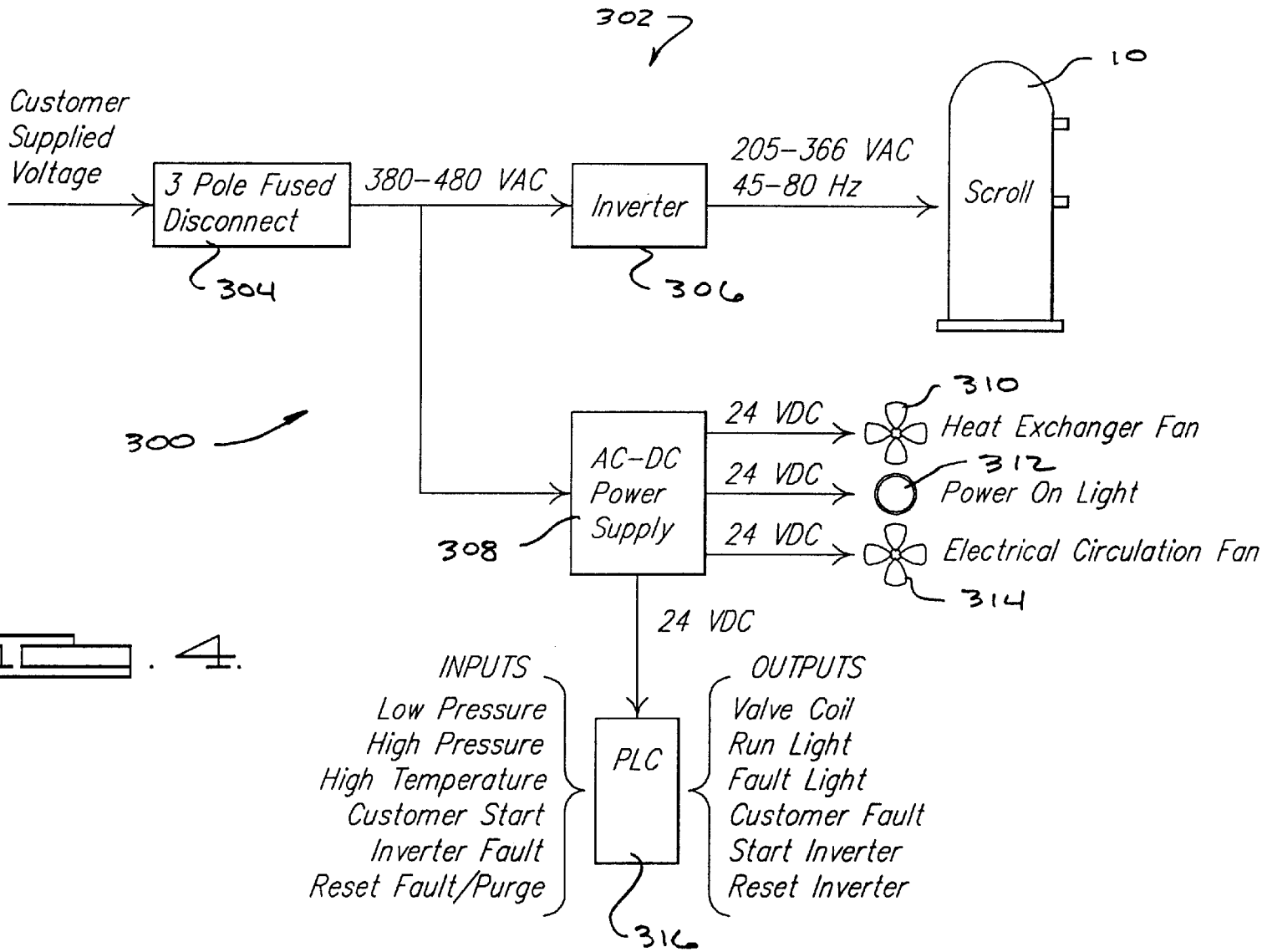
FIG. 4 is a schematic diagram illustrating an electrical architecture for a gas booster control module for the compressor system shown in FIG. 1 which is supplied with an alternating current.

Referring now to FIG. 4, a compression system 300 is illustrated. Compression system 300 includes scroll machine 10 and control system 302. Control system 302 is provided with an alternating current (AC) from a customer supplied voltage. The customer supplied voltage is connected to a three pole fused disconnect 304. From disconnect 304, power is supplied to an inverter 306 and to an AC-DC power supply 308. Inverter 306 receives the customer supplied AC voltage typically in the range of 380–480 VAC at either 50 or 60 Hz and converts this voltage to 205–366 VAC at 45–80 Hz which is required for powering scroll machine 10.

AC-DC power supply 308 receives the customer supplied AC voltage typically in the range of 380–480 VAC at either 50 or 60 Hz and converts this voltage to 24 volts direct current (VDC). The 24 VDC is supplied from power supply 308 to a heat exchanger fan 310, a power on light 312, an electrical circulation fan 314 and a programmable logic control (PLC) 316. PLC 316 also receives input from various sources including, but not limited to, a low pressure sensor, a high pressure sensor, a high temperature sensor, a customer start signal, an inverter fault signal and a reset fault/purge signal. Based on these signals, PLC 316 outputs signals to various devices including, but not limited to, a valve coil, a run light, a fault light, a customer fault signal, a start inverter signal and a reset inverter signal.

The electronic controls for control system 302 provide compressor motor control, digital logic control, low voltage DC power control and filtering, if required. These controls work together to enable compression system 300 to respond to run commands from the customer, fuel demand levels and protective sensor feedback.

As stated above, three pole fused disconnect 304 is supplied with 380/480 VAC with the frequency being at either 50 or 60 Hz. Three pole fused disconnect 304 includes a supply disconnect handle that is easily accessible. Three pole fused disconnect 304 also functions as an overcurrent protection device.

Control system 302 "communicates" with the customer's equipment through at least two discrete signals. A run signal provided to PLC 316 and a fault signal provided by PLC 316. The run signal is provided from the customer's equipment by closing the contacts of a relay typically provided by the customer or by other means known in the art. When the relay contacts are closed, the customer start or run signal is provided to PLC 316. Assuming that there are no faults indicated, PLC 316 will operate compression system 300. If PLC 316 detects a fault from one or more sensors, the customer fault signal is provided by PLC 316 to indicate that there is a fault condition present. The fault signal is typically supplied by closing the relay contacts of a relay which is a part of control system 302. When the relay contacts are closed, compression system 300 is indicating that a fault is present with PLC 316 sending the customer fault signal. As indicated above, fault conditions include, but are not limited to, low inlet pressure, high discharge pressure, high oil temperature and variable speed drive fault (inverter fault).

Compression system 300 is able to maintain a constant delivery pressure of fuel gas for a given flow range. The delivery pressure is monitored by a pressure transducer 320 (FIG. 1) which feeds back the delivery pressure to the variable speed drive for driving motor 38. The variable speed drive is programmed with a pressure set point and will speed up or slow down driving motor 38 based upon the pressure feedback. The variable speed drive can vary the speed by varying the frequency between 45 Hz and 80 Hz. For fuel gas demands less than the demands met by driving motor 38 operating at 45 Hz, pressure regulator or bypass valve 20 becomes active diverting the excess flow of compressed fuel gas back to the inlet of compressor 12.

Figure 4A:
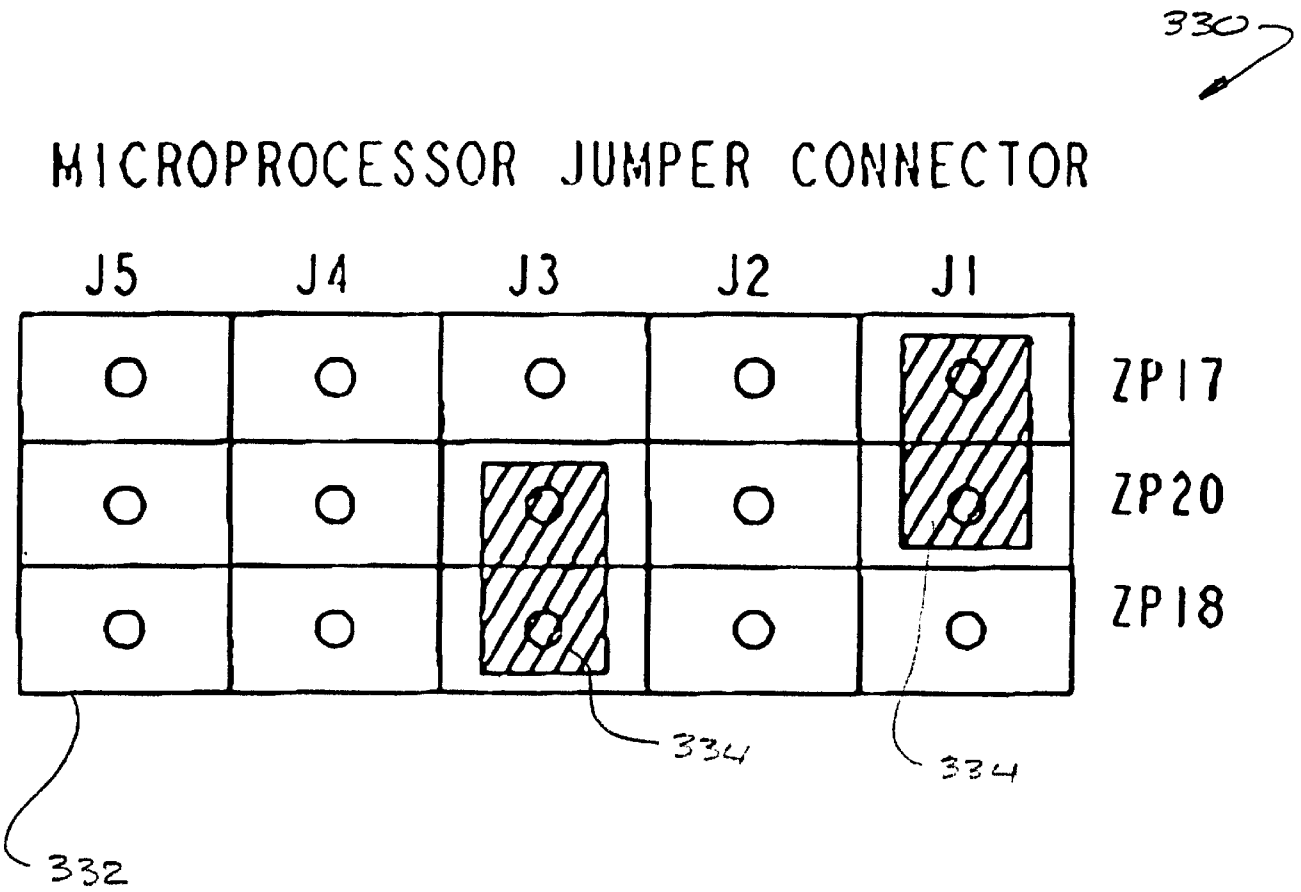
FIG. 4A is a schematic illustration of the jumper board assembly in accordance with the present invention.

Referring now to FIG. 4A, a jumper board system 330 is illustrated. Jumper board system 330 is utilized to program the pressure set point for compression system 300. Jumper board assembly 330 comprises a jumper board 332 and a plurality of Jumpers 334. By arranging the plurality of jumper 334 on jumper board 332, the pressure set point can be programmed between a low pressure set point and a high pressure jet point using a distinct step. In the preferred embodiment, the low pressure set point is 70 PSIG, the high pressure set point is 100 PSIG and the step is 2 PSIG. The pressure set point is programmed by placing jumper 334 between position J5-J2 in the lower row (ZP18) and position J5-J2 in the middle row (ZP20). The programmable range for jumper board system 330 is illustrated in the chart below where "0" designates no jumper 334 and "1" designates the presence of jumper 334.

PRESSURE SET POINT CHART

| J2 | J3 | J4 | J5 | PRESSURE | SET POINT |
|---|---|---|---|---|---|
| 0 | 0 | 0 | 0 | 70 | PSIG |
| 0 | 0 | 0 | 1 | 72 | PSIG |
| 0 | 0 | 1 | 1 | 74 | PSIG |
| 0 | 0 | 1 | 1 | 76 | PSIG |
| 0 | 1 | 0 | 0 | 78 | PSIG |
| 0 | 1 | 0 | 1 | 80 | PSIG |
| 0 | 1 | 1 | 0 | 82 | PSIG |
| 0 | 1 | 1 | 1 | 84 | PSIG |
| 1 | 0 | 0 | 0 | 86 | PSIG |
| 1 | 0 | 0 | 1 | 88 | PSIG |
| 1 | 0 | 1 | 0 | 90 | PSIG |
| 1 | 0 | 1 | 1 | 92 | PSIG |
| 1 | 1 | 0 | 0 | 94 | PSIG |
| 1 | 1 | 0 | 1 | 96 | PSIG |
| 1 | 1 | 1 | 0 | 98 | PSIG |
| 1 | 1 | 1 | 1 | 100 | PSIG |

In FIG. 4A, the pressure set point is programmed to 78 PSIG. Jumper board system 330 simplifies the programming for the pressure set point due to its accessibility to the user of the system and/or the service technician.

The advantages to compression system 300 include safety, efficiency and flexibility Compression system 300 is a safe system due to its ability to respond to condition that may be hazardous to people or to the equipment itself. The efficiency advantage are due to the variable speed control of compressor 12 which uses the minimum amount of power for a given fuel demand level. The flexibility of compression system 300 is dependent on programmable logic control 316 which allows customization to meet varying customer requirements.

Figure 5:
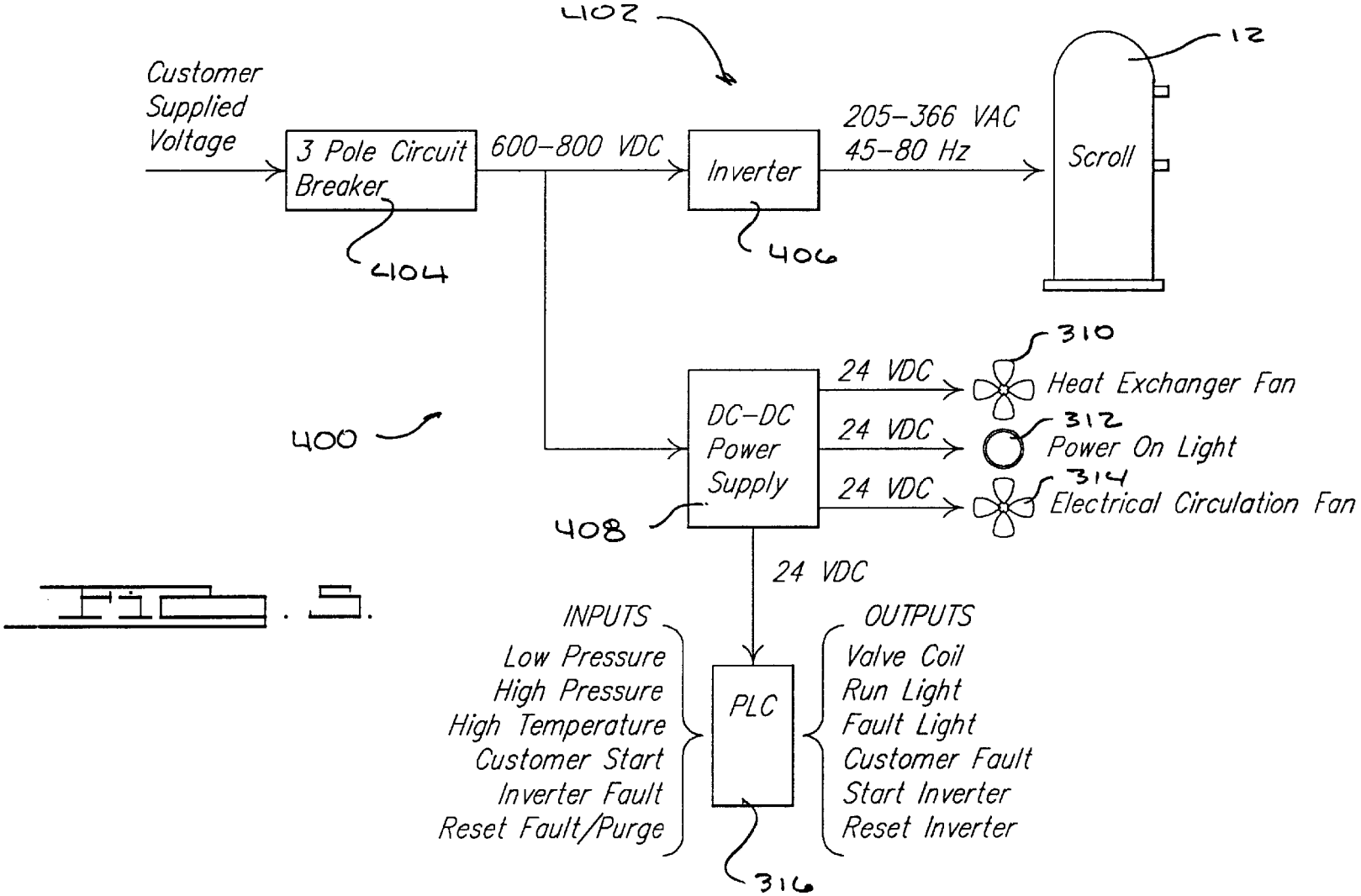
FIG. 5 is a schematic diagram illustrating an electrical architecture for a gas booster control module for the compressor system shown in FIG. 1 which is supplied with a direct current.

Referring now to FIG. 5, a compression system 400 is illustrated. Compression system 400 includes scroll machine 10 and control system 402. Control system 402 is provided with a direct current (DC) from a customer supplied voltage. The customer supplied voltage is corrected to a three pole fused circuit breaker 404. From circuit breaker 404, power is supplied to an inverter 406 and to DC-DC power supply 408. Inverter 406 receives the customer supplied DC voltage typically in the range of 600–800 VDC and converts this voltage to 205–366 VAC at 45–80 Hz which is required for powering scroll machine 10.

DC-DC power supply 408 receives the customer supplied DC voltage typically in the range of 600–800 VDC and converts this voltage to 24 volts direct current (VDC). The 24 VDC is supplied from power supply 408 to heat exchanger fan 310, power on light 312, electrical circulation fan 314 and programmable logic control (PLC) 316. PLC 316 also receives input from various sources including, but not limited to, a low pressure sensor, a high pressure sensor, a high temperature sensor, a customer start signal an inverter fault signal and a resent fault/purge signal. Based on these signals, PLC 316 outputs signals to various devices including, but not limited to, a valve coil, a run light, a fault light, a customer fault signal, a start inverter signal and a reset inverter signal.

The electronic controls for control system 402 provide compressor motor control, digital logic control, low voltage DC power control and filtering if required. These controls work together to enable compression system 400 to respond to run commands from the customer, fuel demand levels and protective sensor feedback.

As stated above, circuit breaker 404 is supplied with 600–800 VDC. Circuit breaker 404 includes a supply disconnect handle that is easily accessible. Circuit breaker 404 also functions as an overcurrent protection device.

Control system 402 "communicates" with the customer's equipment through at least two discrete signals. A run signal provided to PLC 316 and a fault signal provided by PLC 316. The run signal is provided from the customer's equipment by closing the contacts of a relay typically provided by the customer or by other means known in the art. When the relay contacts are closed, the customer start or run signal is provided to PLC 316. Assuming that there are no faults indicated PLC 316 will operate compression system 400. If PLC 316 detects a fault from one or more sensors, the customer fault signal is provided by PLC 316 to indicate that there is a fault condition present. The fault signal is typically supplied by closing the relay contacts of a relay which is a part of control system 402. When the relay contacts are closed, compression system 400 is indicating that a fault is present with PLC 316 sending the customer fault signal. As indicated above, fault conditions include, but are not limited to, low inlet pressure, high discharge pressure, high oil temperature and variable speed drive fault (inverter fault).

Compression system 400 is able to maintain a constant delivery pressure of fuel gas for a given flow range. The delivery pressure is monitored by pressure transducer 320 (FIG. 1) which feeds back the delivery pressure to the variable speed drive per driving motor 38. The variable speed drive is programmed with a pressure set point and will speed up or slow down driving motor 38 based upon the pressure feedback. The variable speed drive can vary the speed by varying the frequency between 45 Hz and 80 Hz. For fuel gas demands less than the demands met by driving motor 38 operating at 45 Hz, pressure regulator or bypass valve 20 becomes active diverting the excess flow of compressed fuel gas back to the inlet of compressor 12. Compression system 400 also incorporates jumper board system 330 for programming the pressure set point as detailed above for compression system 300.

The advantages to compression system 400 include safety, efficiency and flexibility. Compression system 400 is a safe system due to its ability to respond to conditions that may be hazardous to people or to the equipment itself. The efficiency advantages are due to the variable speed control of compressor 12 which uses the minimum amount of power for a given fuel demand level. The flexibility of compression system 400 is dependent on its programmable logic control 316 which allows customization to meet varying customer requirements.

Compression system 400 provides additional advantages to applications which require the system to start off battery power. Since the battery voltage is DC, it is desirable to start and run compression system 400 using the DC voltage. If the DC supply voltage is used, it leads to a smaller DC to AC conversion output module since it is unnecessary to supply compression system 400 with AC through that module.

Figure 6:
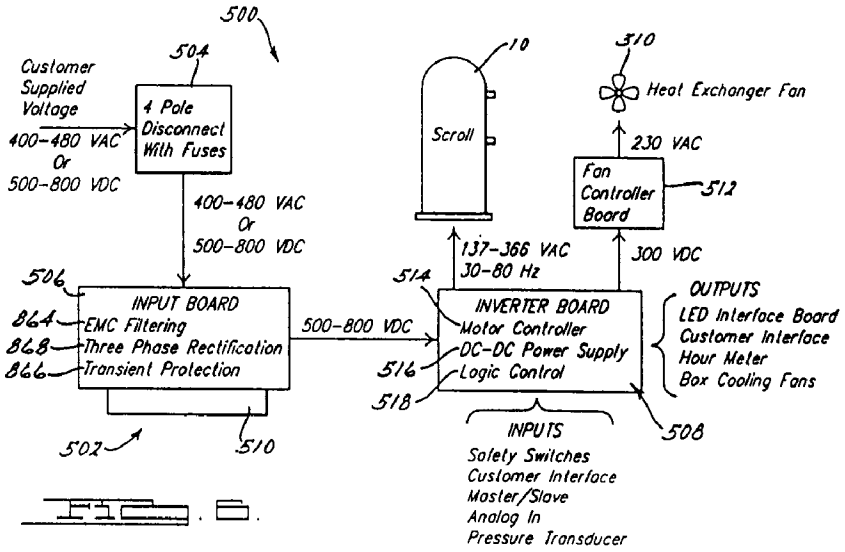
FIG. 6 is a schematic diagram illustrating an electrical architecture for a gas booster control module for the compressor system shown in FIG. 1 which can be supplied with either an alternating current or a direct current.
Figure 7:
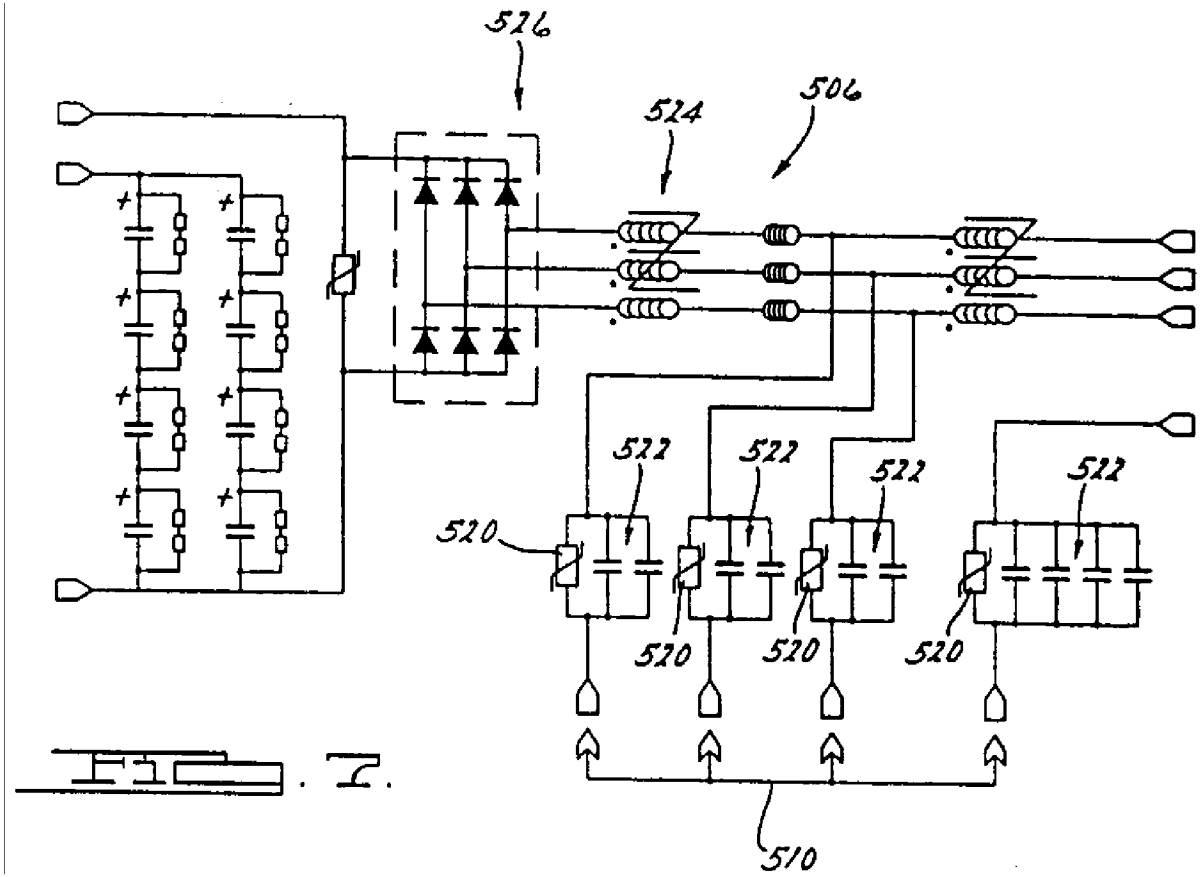

Referring now to FIG. 6, a compression system 500 is illustrated. Compression system 500 includes compressor or scroll machine 10 and control system 502. Control system 502 is provided with either an alternating current (AC) or a direct current (DC) from a customer supplied voltage. The customer supplied voltage is connected to a four pole fused disconnect 504. From fused disconnect 504, power is supplied to an input board 506. Input board 506 receives the customer supplied AC or DC voltage typically in the range of 400–480 VAC at either 50 or 60 Hz for AC or 500–800 VDC for DC and outputs a 500—800 VDC to an inverter board 508. A jumper card 510 is utilized with input board 506 for switching between an AC or a DC signal being supplied to input board 506. Details of jumper card 510 are discussed below in reference to FIG. 7.

Inverter board 508 receives the 500–800 VDC voltage from input board 506 and it supplies power to scroll machine 10 and a fan controller board 512. Inverter board 508 includes a DSP (digital signal processor) based motor controller 514, a DC-DC power supply 516 and a microprocessor based programmable logic control system 518. Motor controller 514 receives the 500–800 VDC voltage from input board 506 and converts this voltage to 137–366 VAC at 30–80 Hz which is required to power scroll machine 10. In addition, motor controller 514 is capable of varying the capacity for scroll machine 10 in response to a signal received from microprocessor based programmable logic control system 518 as discussed below. DC-DC power supply 516 also receives the 500–800 VDC voltage from input board 506 and converts this voltage to 300 VDC which is supplied to fan controller board 512. Fan controller board 512 converts the power to 230 VAC and supplied this power to heat exchanger fan 310 based on input it receives from microprocessor based programmable logic control system 518.

MBP logic control system 518 receives power from input board 506 and it also receives input from various sources including, but not limited to, various safety switches, the customer's interface, a master/slave signal, an analog in signal and a pressure transducer signal. Based on these input signals, MBP logic control system 518 outputs voltage to power scroll machine 10, power to fan controller board 512 and output signals to various devices. These output signals include, but are not limited to a LED interface board, the customer interface, an hour meter and the box cooling fans.

The electronic controls for control system 502 provide for compressor motor control, digital logic control, low voltage DC power control and filtering, if required. These controls work together to enable control system 502 and thus compression system 500 to respond to run commands from the customer, fuel demand levels and protective sensor set back.

As stated above, four pole fused disconnect 504 is supplied with either 400–480 VAC with the frequency being 50–60 Hz or 500–800 VDC. Four pole fused disconnect 504 includes a supply disconnect handle that is easily accessible. Four pole fused disconnect 504 also functions as an overcurrent protection device. The power from four pole fused disconnect 504 is transmitted to input board 506. A further detailed description for control system 502 is presented below in reference to FIG. 13.

Figure 7:
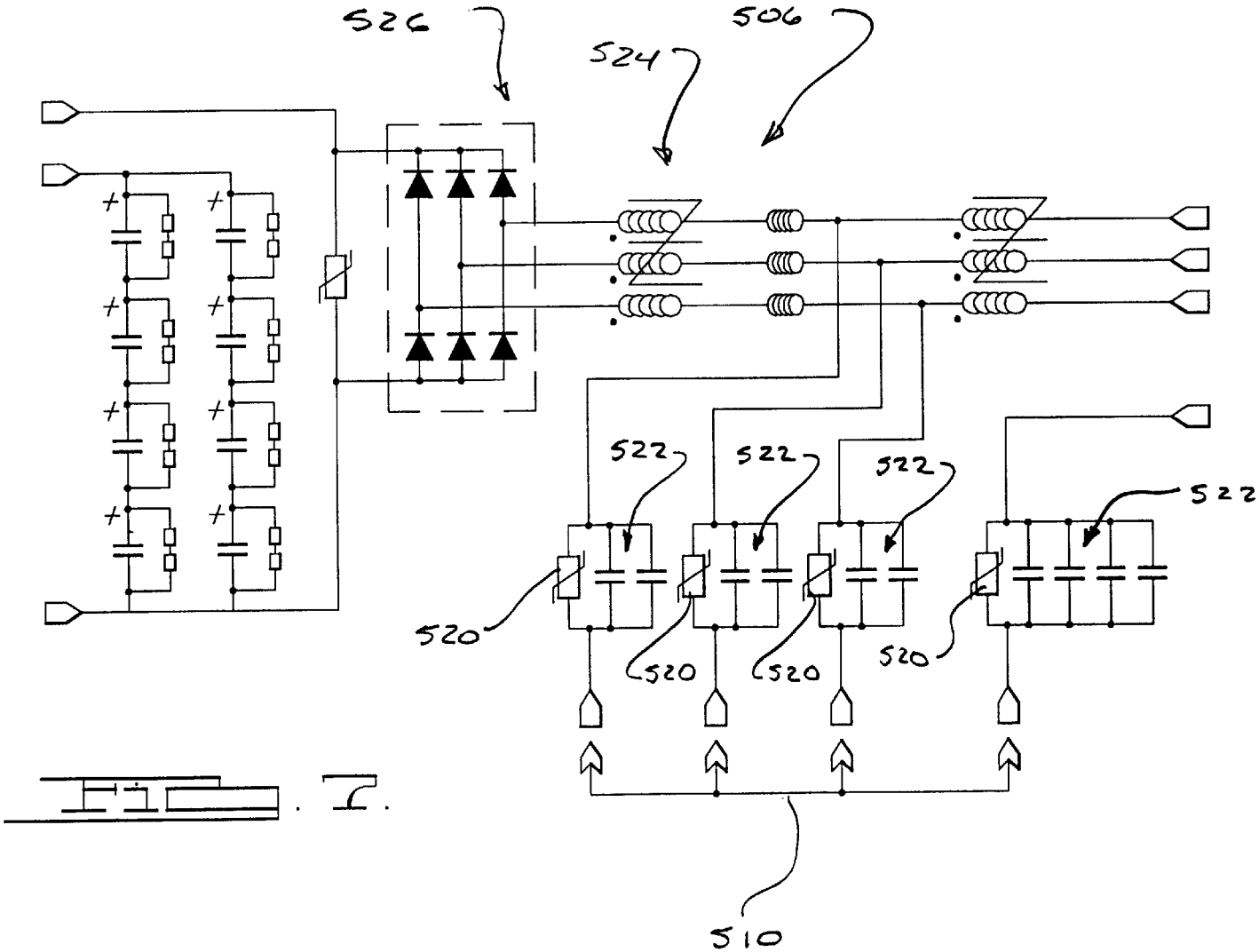
FIG. 7 is a schematic illustration of the jumper system which is utilized in FIG. 6 to switch between AC and DC supply.

Referring now to FIG. 7, the input scheme for input board 506 is illustrated. Jumper card 510 illustrated in FIG. 7, is utilized when the input power to four pole fused disconnect 504 is AC power. Each of the three phase circuits plus ground include at least one metal-oxide-varistor (MOV) 520 and a plurality of capacitors 522 which are located between each phase of the power supply and ground. Jumper card 510 completes the connection to ground for all of the circuits that lead to ground to provide transient or surge protection for the supplied AC voltage. Input board 506 also includes a diode module 524 and an EMC filtering device 526 which converts the supplied AC power into DC power. When DC power is supplied to four pole fused disconnect 504, jumper 510 is removed to take MOV's 520 and capacitors 522 out of the circuit.

Control system 502 communicates with the customer's equipment through at least two discrete signals. A run signal provided to logic control system 518 and a fault signal provided by logic control system 518 are two of these signals. The run signal is provided from the customer's equipment by closing the contacts of a relay typically provided by the customer or by other means known in the art. When conditions indicate a need, the relay contacts are closed and the customer's start or run signal is provided to logic control system 518. Assuming that there are no faults indicated, logic control system 516 will operate compression system 500. If logic control system 518 detects a fault from one or more sensors, the customer fault signal is provided by logic control system 518 to indicate that there is a problem with the system. The fault signal is typically supplied by closing the relay contacts of a relay which is a part of compression system 500. When the relay contacts are closed, compression system 500 is indicating a fault is present with logic control system 518 sending the customer fault signal.

Compression system 500 is able to maintain a constant delivery pressure of fuel gas for a given flow range. The delivery pressure is monitored by a pressure transducer which feeds back the delivery to motor controller 514 of logic control system 518 which controls the speed for driving motor 38. The variable speed is programmed with a pressure set point and it will speed up or slow down driving motor 38 based upon the pressure feed back. The variable speed drive can vary the speed by varying the frequency between 45 Hz and 80 Hz. For fuel gas demands less than the demands met by driving motor 38 operating at 45 Hz, pressure regulator or bypass valve 20 becomes active diverting the excess flow of compression fuel gas back to the inlet of compressor 12. Compression system 500 also incorporates jumper board system 330 for programming the pressure set point as detailed above for compression system 300.

The advantages to compression system 500 include safety, efficiency, flexibility and the ability to supply either AC or DC power to the system. Compression system 500 is a safe system due to its ability to respond to conditions that may be hazardous to people or to the equipment itself. The efficiency advantages are due to the variable speed control of compressor 12 which uses the minimum amount of power for a given fuel demand level. The flexibility of compression system 500 is dependent on programmable logic control system 518 which allows customization to meet varying customer requirements as well as the ability to supply either AC or DC power.

Figure 9:
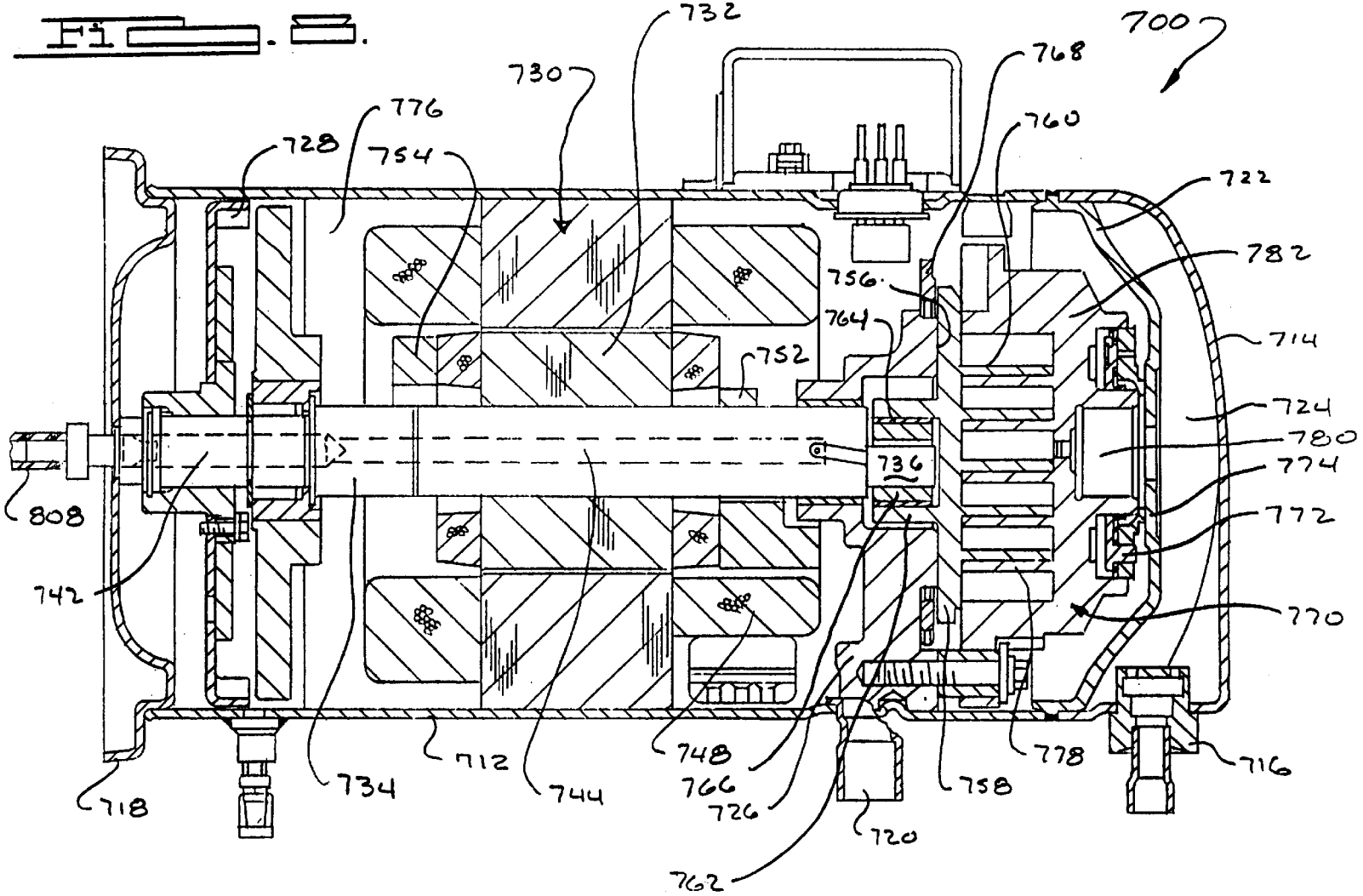
FIG. 9 is a detailed cross-sectional view of the oil injection fitting shown in FIG. 8.
Figure 9:
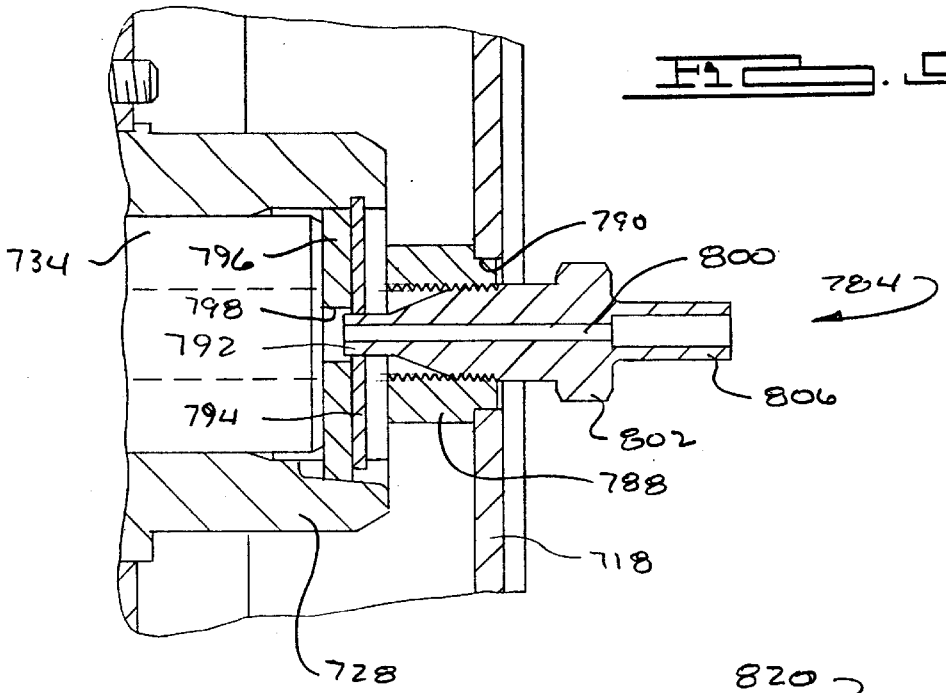
Figure 8:
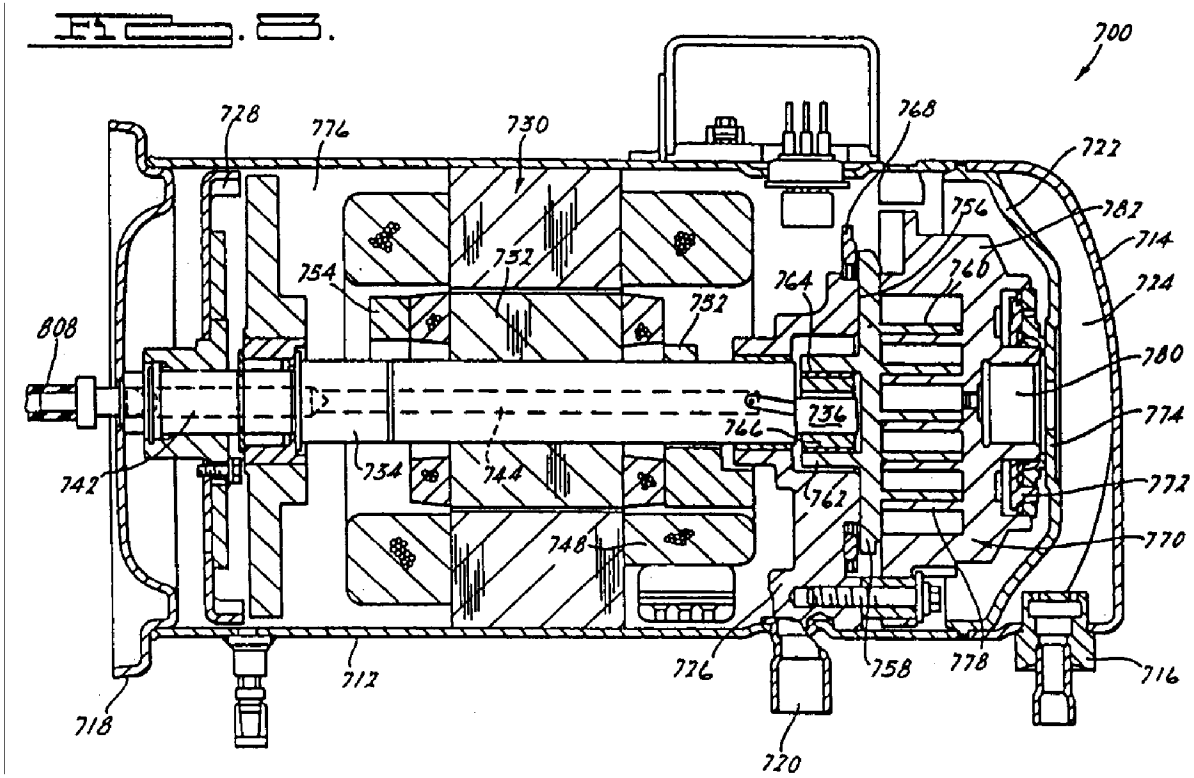
FIG. 8 is a vertical cross-sectional view of a scroll compressor in accordance with another embodiment of the present invention.
Figure 9:
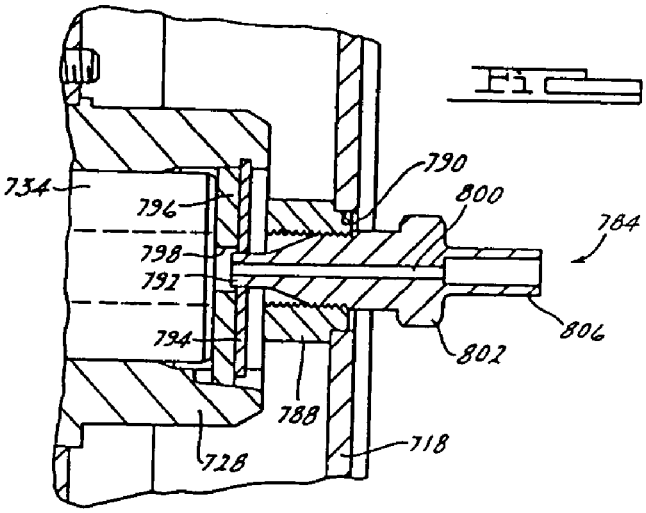
Figure 10:
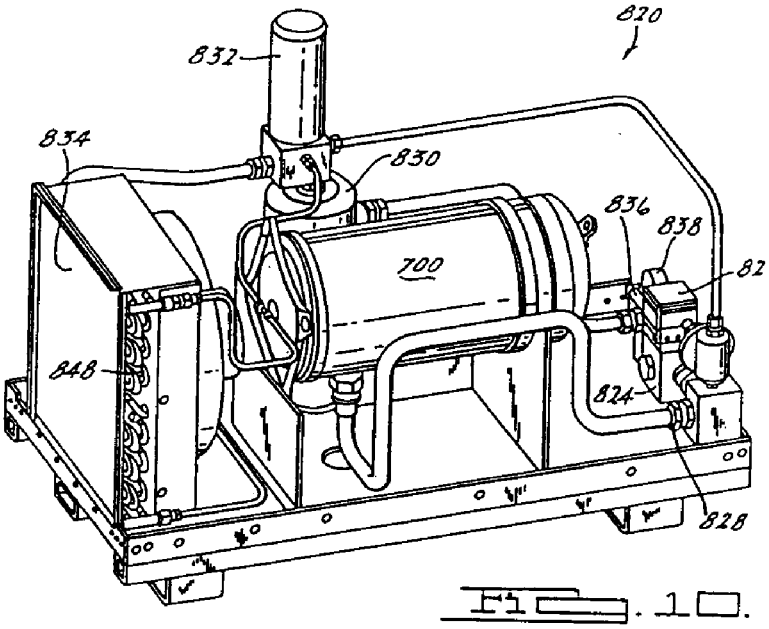
Figure 11:
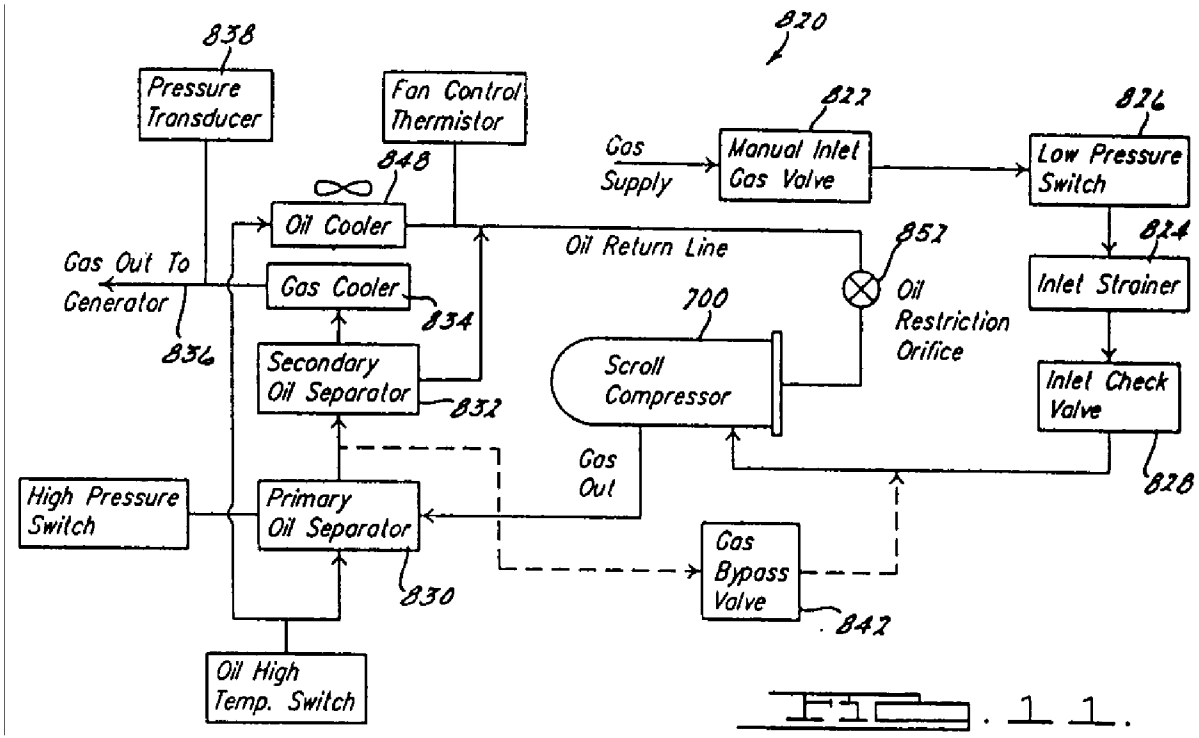
Figure 12:
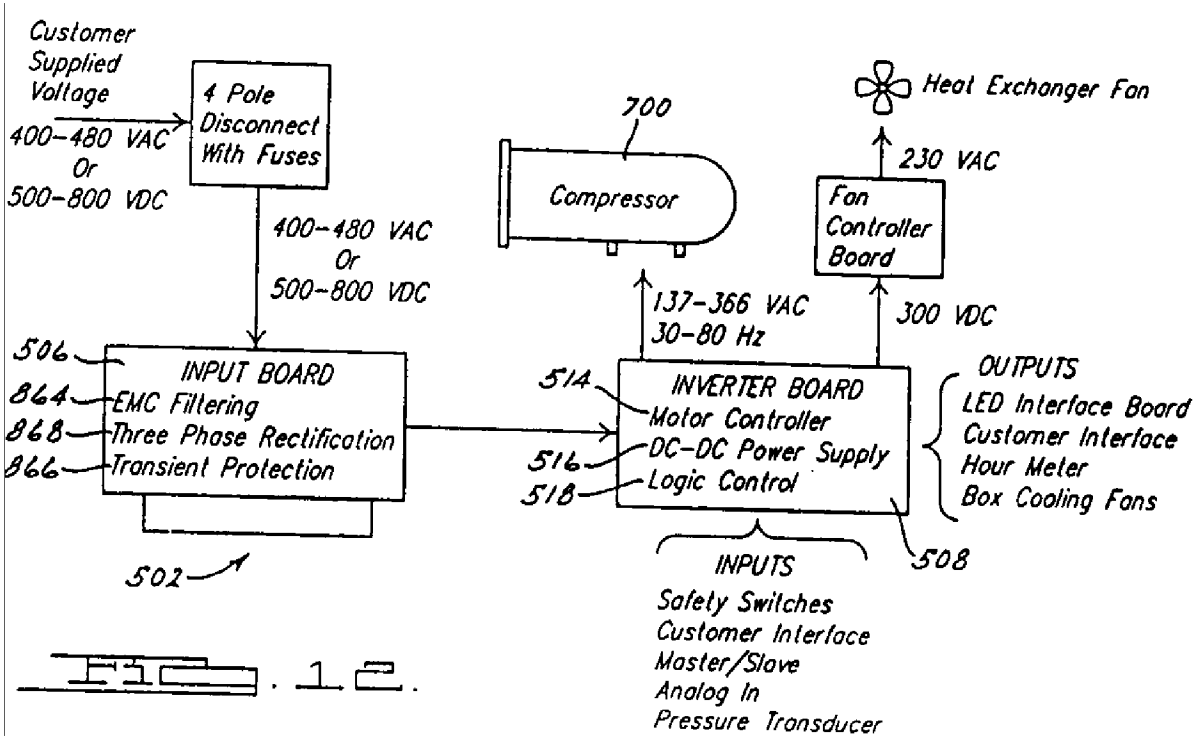
Figure 12:
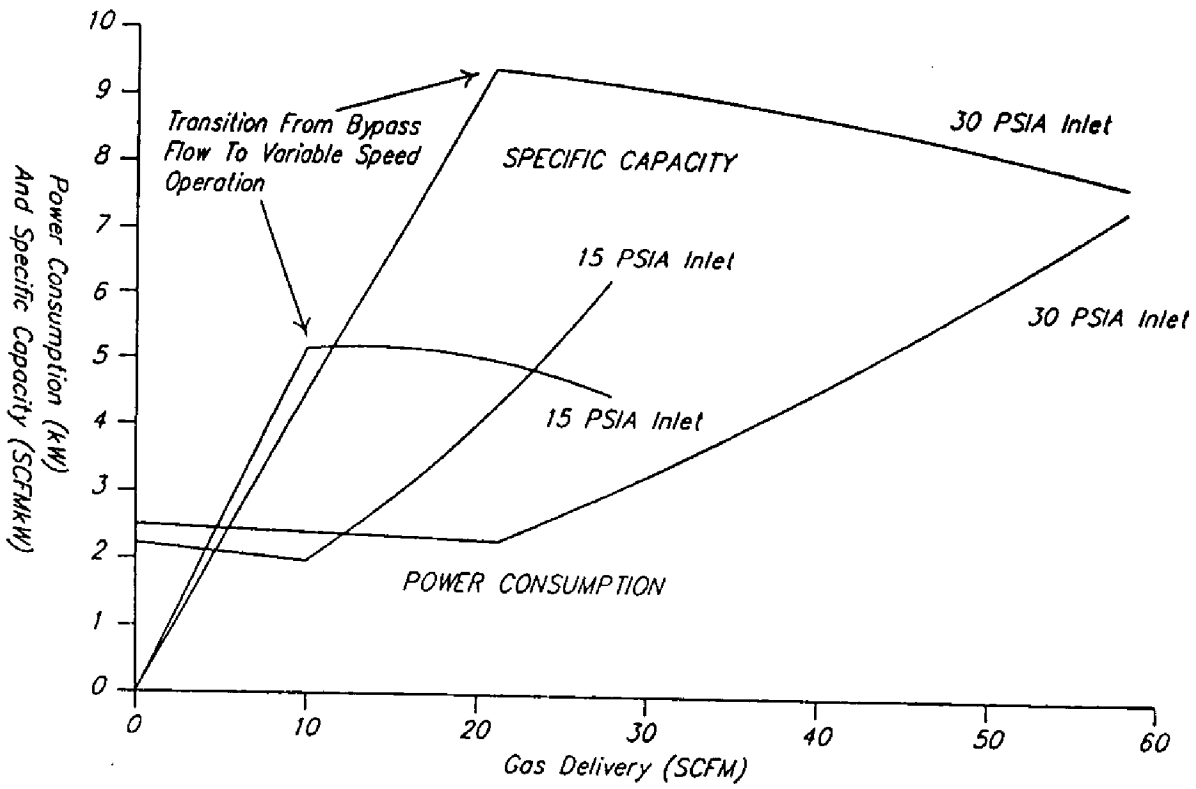

Referring now to FIGS. 8 and 9, a horizontal scroll compressor 700 in accordance with another embodiment of the present invention is illustrated. Scroll compressor 700 comprises a generally cylindrical hermetic shell 712 having welded at one end thereof a cap 714. Cap 714 is provided with a discharge fitting 716 which may have the usual discharge valve therein. Other major elements affixed to the shell include a base cap 718, an inlet fitting 720 and a transversely extending partition 722 which is welded about its periphery at the same point that cap 714 is welded to cylindrical shell 712. A discharge chamber 724 is defined by cap 714 and partition 722.

A main bearing housing 726 and a lower bearing housing 728 having a plurality of radially outwardly extending legs are each secured to cylindrical shell 712. A motor 730 which includes a rotor 732 is supported within cylindrical shell 712 between main bearing housing 726 and second bearing housing 728. A crank shaft 734 having an eccentric crank pin 736 at one end thereof is rotatably journaled in bearing housing 726 and second bearing housing 728.

Crank shaft 734 has, at a second end, a relatively large diameter concentric bore 742 which communicates with a radially outwardly smaller diameter bore 744 extending therefrom to the first end of crankshaft 734.

Crank shaft 734 is rotatably driven by electric motor 730 including rotor 732 and stator windings 748 passing therethrough. Rotor 732 is press fitted on crank shaft 734 and includes first and second counterweights 752 and 754 respectively.

A first surface of main bearing housing 726 is provided with a flat thrust bearing surface 756 against which is disposed an orbiting scroll 758 having the usual spiral vane or wrap 760 on a first surface thereof. Projecting from a second surface of orbiting scroll 758 is a cylindrical hub 762 having a journal bearing 764 therein in which is rotatably disposed a drive bushing 766 having an inner bore in which crank pin 736 is drivingly disposed. Crank pin 736 has a flat on one surface which drivingly engages a flat surface (not shown) formed in a portion of the bore in drive bushing 766 to provide a radially compliant driving arrangement, such as shown in assignee's U.S. Pat. No. 4,877,382, the disclosure of which is hereby incorporated herein by reference.

An Oldham coupling 768 is disposed between orbiting scroll 758 and bearing housing 726. Oldham coupling 768 is keyed to orbiting scroll 758 and a non-orbiting scroll 770 to prevent rotational movement of orbiting scroll member 758. Oldham coupling 768 is preferably of the type disclosed in assignee's U.S. Pat. No. 5,320,506, the disclosure of which is hereby incorporated herein by reference. A floating seal 772 is supported by the non-orbiting scroll 770 and engages a seat portion 774 mounted to partition 722 for sealingly dividing an intake chamber 776 and discharge chamber 724.

Non-orbiting scroll member 770 is provided having a wrap 778 positioned in meshing engagement with wrap 760 of orbiting scroll 758. Non-orbiting scroll 770 has a centrally disposed discharge passage 780 defined by a base plate portion 782. Non-orbiting scroll 770 also includes an annular hub portion which surrounds discharge passage 780. A dynamic discharge valve or read valve can be provided in discharge passage 780 if desired.

An oil injection fitting 784, as best shown in FIG. 9, is provided through bottom cap 718 which is connected to shell 712. Oil injection fitting 784 is threadedly connected to a fitting 788 which is welded within an opening 790 provided in bottom cap 718. Fitting 788 includes an internally threaded portion which is threadedly engaged by an externally threaded portion provided at one end of oil injection fitting 784. A nipple portion 792 extends from the externally threaded portion of oil injection fitting 784. Nipple portion 792 extends with an opening provided in a snap ring 794 which is disposed in lower bearing housing 728. Snap ring 794 holds a disk member 796 in contact with the lower end of crankshaft 734. Disk member 796 includes a hole 798 which receives, with a clearance, the end of nipple portion 792 therein. Oil injection fitting 784 includes an internal oil passage 800 extending longitudinally therethrough which serves as a restriction on the oil flow. Oil injection fitting 784 includes a main body portion 802 which is provided with a tool engaging portion (such as a hex shaped portion which facilitates the insertion and removal of the fitting 784 by a standard wrench). Oil injection fitting 784 further includes a second nipple portion 806 extending from main body 802 in a direction opposite to first nipple portion 792. Second nipple portion 806 is adapted to be engaged with a hose or tube 808 which supplies oil to fitting 784.

Oil is delivered to fitting 784 and into concentric bore 742, in crankshaft 734 through oil passage 800 extending through fitting 784. Concentric bore 742 extends to bore 744 which in turn extends through crankshaft 734 to provide lubricating oil to the various bearings, the scroll members and other components of compression 700 which require lubrication.

Figure 10:
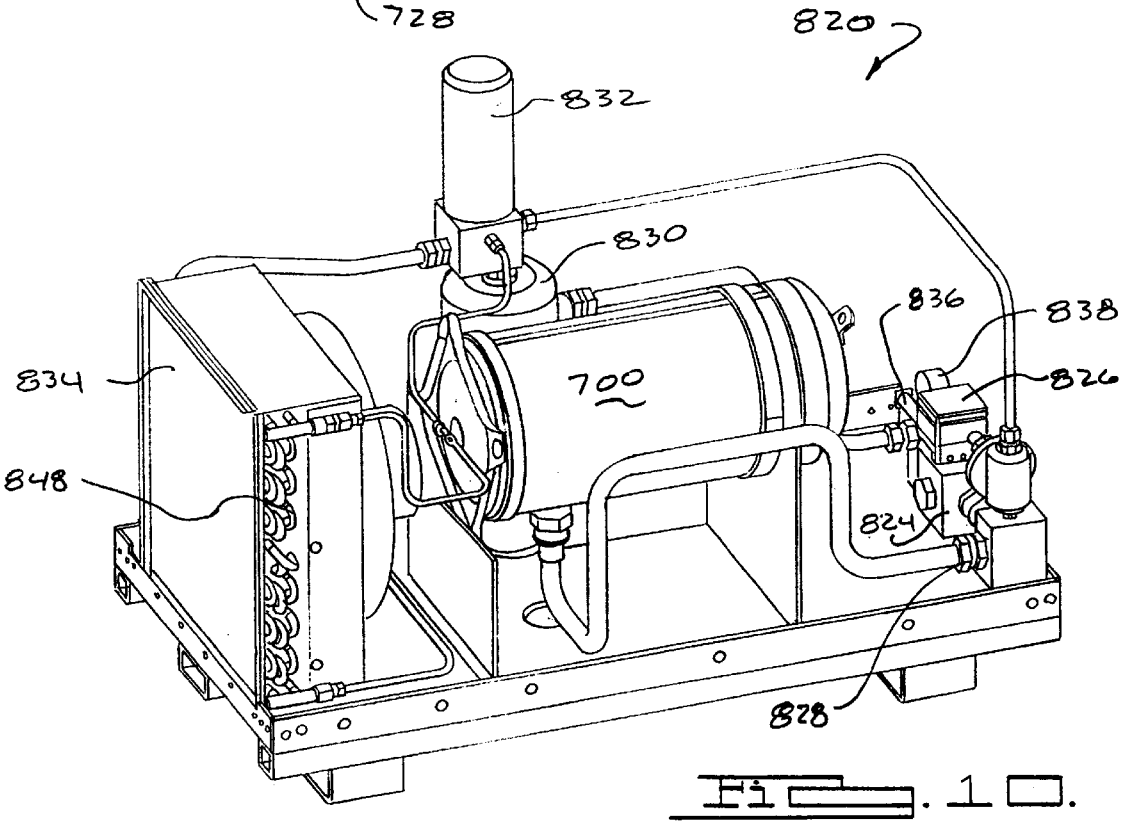
FIG. 10 is an external elevational view of a fuel gas compression system in accordance with another embodiment of the present invention.
Figure 11:
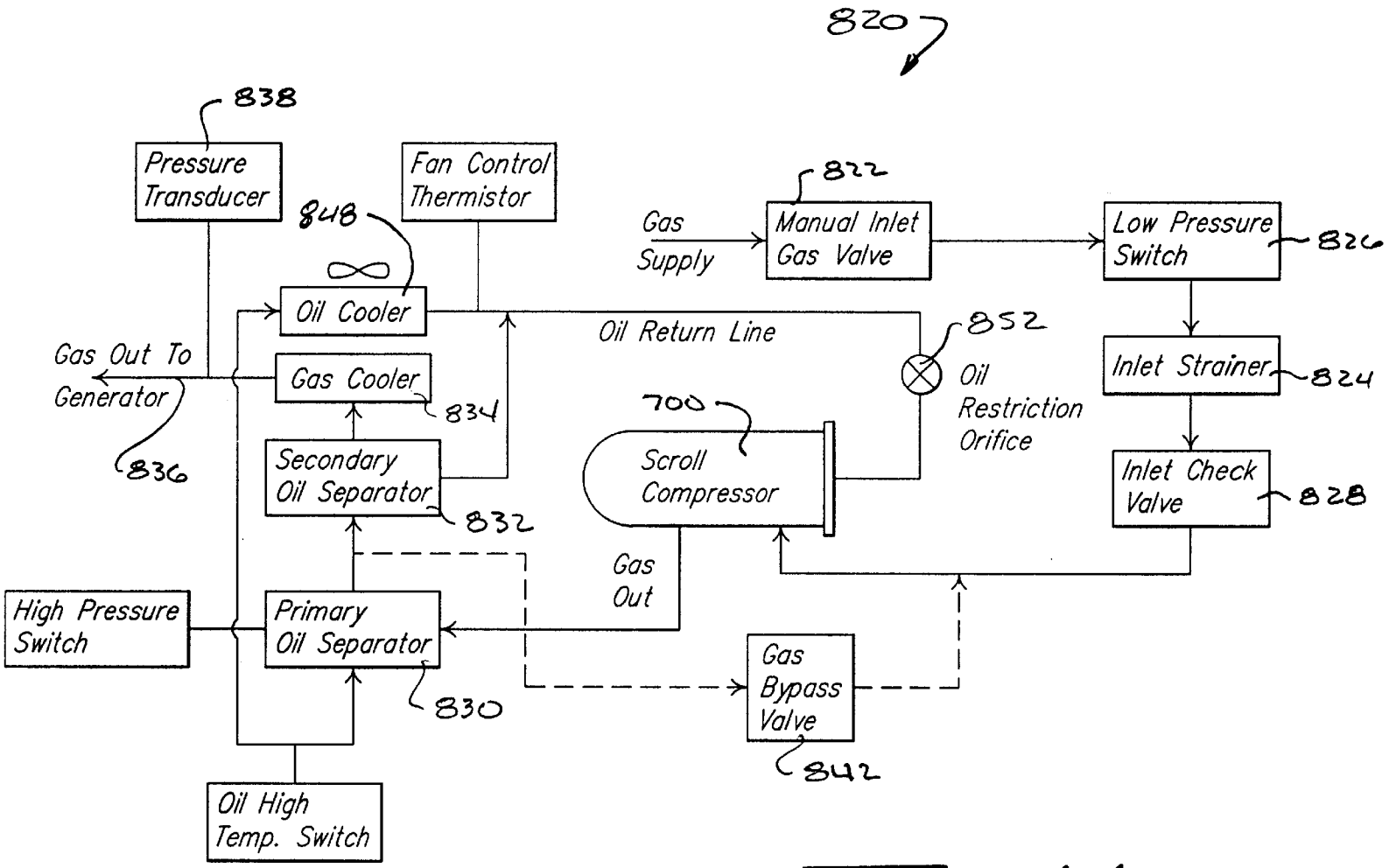
FIG. 11 is a schematic diagram showing the fuel gas compression system shown in FIG. 10.

Referring now to FIGS. 10 and 11, scroll compressor 700 is illustrated as part of a fuel gas compression system 820. Fuel gas compression system 820 is a complete stand-alone system capable of boosting fuel gas pressure from as little as 0.25 psig to up to 100 psig in a single stage of compression. To illustrate the operation of fuel gas compression system 820, fuel gas flow will be followed from inlet to outlet connections.

Fuel gas enters fuel gas compression system 820 through an inlet connection 822 and flows through an inlet filter 824, a low pressure switch 826 and a check valve 828 to compressor 700. For safety purposes, low-pressure switch 826 prevents fuel gas from being extracted from adjacent appliances, and check valve 828 prevents the pressurization of the supply line due to reverse gas flow on compressor shutdown. Upon entering compressor 700, the fuel gas enters the scroll compression elements and is compressed to the desired pressure. Oil from the lubrication process also enters the scrolls and serves to provide cooling to the gas compression process. High-pressure gas and oil then leave compressor 700 and flow through a first and a second stage oil separator 830, 832 where the oil in the gas is reduced to less than 5 ppm. High-pressure gas next passes through a gas heat exchanger 834 to an outlet connection 836 where a pressure transducer 838 provides a feedback signal to the electronic variable speed drive for compressor 700. To accommodate minimal fuel demand requirements, a bypass valve 842 is included to divert high-pressure gas back to the inlet side of compressor 700.

Power generation applications supported by fuel gas compression system 820 require fuel to be delivered as needed at the design outlet pressure. During the start up mode, the fuel demand may be zero, while during normal full load operation, the fuel demand may be variable due to power generator size, inlet pressure and temperature, and gas heating value. For generator part load operation, fuel requirements may be 50% or less of full load. To meet the need of these variability requirements, fuel gas compression system 820 includes both bypass valve 842 and the electronic variable speed drive for compressor 700. For the zero fuel requirements needed during generator start up, bypass valve 842 controls fuel flow. For normal flow operation, the electronic variable speed drive for compressor 700 controls compressor motor speed from 1800 to 4800 RPM. Pressure transducer 838 at the gas exit of the system provides the necessary feedback signal to the electronic variable speed drive for compressor 700 to hold fuel pressure at the programmed pressure set point. System overload and safety shutdown features are also included in the onboard electronic package designed specifically for this application as detailed below. Fuel gas compression system 820 also incorporates jumper board system 330 for programming the pressure set point as detailed above for compression system 300.

Compressor 700 used with fuel gas compression system 820 is a positive displacement scroll type hermetic design as detailed above. In a scroll type compressor 700, two identical involute scroll elements 760, 778 fit together to form a number of "pockets" which continually change in size and location as the gas is compressed. Scroll 778 of non-orbiting scroll member 770 remains stationary while scroll 760 of orbiting scroll member 758 orbits about it. This orbiting scroll movement draws gas into two outer chambers and them moves it through successively smaller volume chambers until it reaches a maximum pressure at the involute center. At this point, the gas is released through discharge passage 780 in non-orbiting scroll member 770.

During each orbit of orbiting scroll member 758 multiple gas pockets are compressed simultaneously so that compression is virtually continuous. Gas entering the scrolls requires approximately three orbits, or crankshaft rotations, to reach the discharge pressure. This extended duration compression process results in a smooth, efficient and quiet delivery of high-pressure gas to the end product. The scroll compression process is optimal at the design pressure ratio (based on the design volume ration) but works well with minor efficiency loss at higher-pressure ratios. For the fuel gas compression application, a design pressure ratio of 3 works efficiently over the required operating pressure ratios of 3 to 7.

Fuel gas compression requires additional compressor and system design considerations not present in conventional air conditioning applications. With the high specific heat ratio of natural gas compression of 1.35 versus 1.15 for typical refrigerants, discharge gas temperatures can approach 500° F. at higher-pressure ratios. To control discharge temperatures below a 300° F. oil degradation level, an oil flooded compressor design was developed as shown in FIG. 11.

Both oil and gas flow processes are illustrated for this unique horizontal scroll design which includes a high-pressure oil sump (first on primary oil separator 830 versus the conventional low pressure oil sump used with vertical style scroll compressors. From the high-pressure sump or primary oil separator 830, oil is routed through an oil cooler 848 and then back to compressor 700. Second oil separator 832 receives gas mixed with oil from first oil separator 830 and it directs the gas to gas heat exchanger 834 and then to outlet connection 836. Outlet connection 836 communicates with a pressurized gas mechanism which can be a microturbine power generator, a diesel driven generator conversion, a fuel cell or any other type of compressed gas user. Oil from second oil separator 832 is joined with oil from oil cooler 848 and this oil is injected directly into compressor 700 to lubricate the bearing components. As oil flows from the bearing system, it provides cooling to the interrial motor and collects in the lower area of compressor shell 712. When the oil level reaches the inlet of scroll members 758 and 770, oil along with gas enters the scroll compression process where it provides cooling to the compressed gas. Due to the mixing of the oil and gas during compression, gas temperatures are typically well below 200° F. for all operating pressure ratios.

As high pressure gas leaves compressor discharge fitting 716, it goes through two states of oil separation to minimize yearly oil loss to a small percentage of the available oil sump. Then, before leaving compression system 820, the gas is cooled by gas heat exchanger 834 to below 150° F. to meet the maximum gas temperature requirement typical of generator fuel control valves. Oil separated in the first and second stage oil separators 830 and 832 is returned to compressor 700 through an oil supply line. The quantity of oil flow to compressor 700 is controlled through the use of an orifice 852 sized to insure adequate bearing lubrication and gas cooling but not allow excessive oil flooding and viscous drag. Overall, high volumetric and energy efficiencies are obtained with this design approach while potentially damaging high gas temperatures are avoided.

Figure 12:
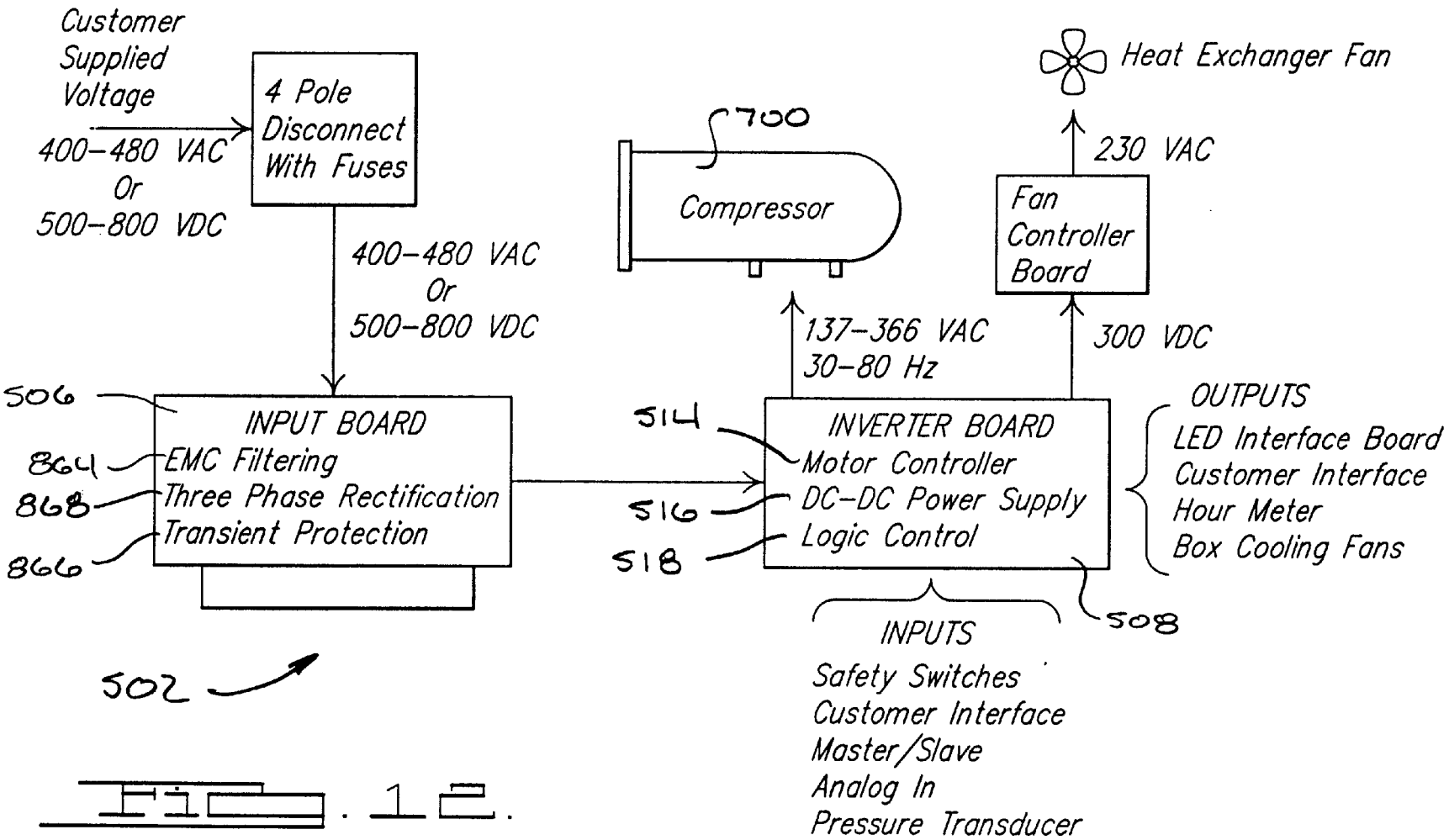
FIG. 12 is a schematic diagram of the electronic architecture of the gas booster control module for operating the fuel gas compression system illustrated in FIGS. 10 and 11.
Figure 12:
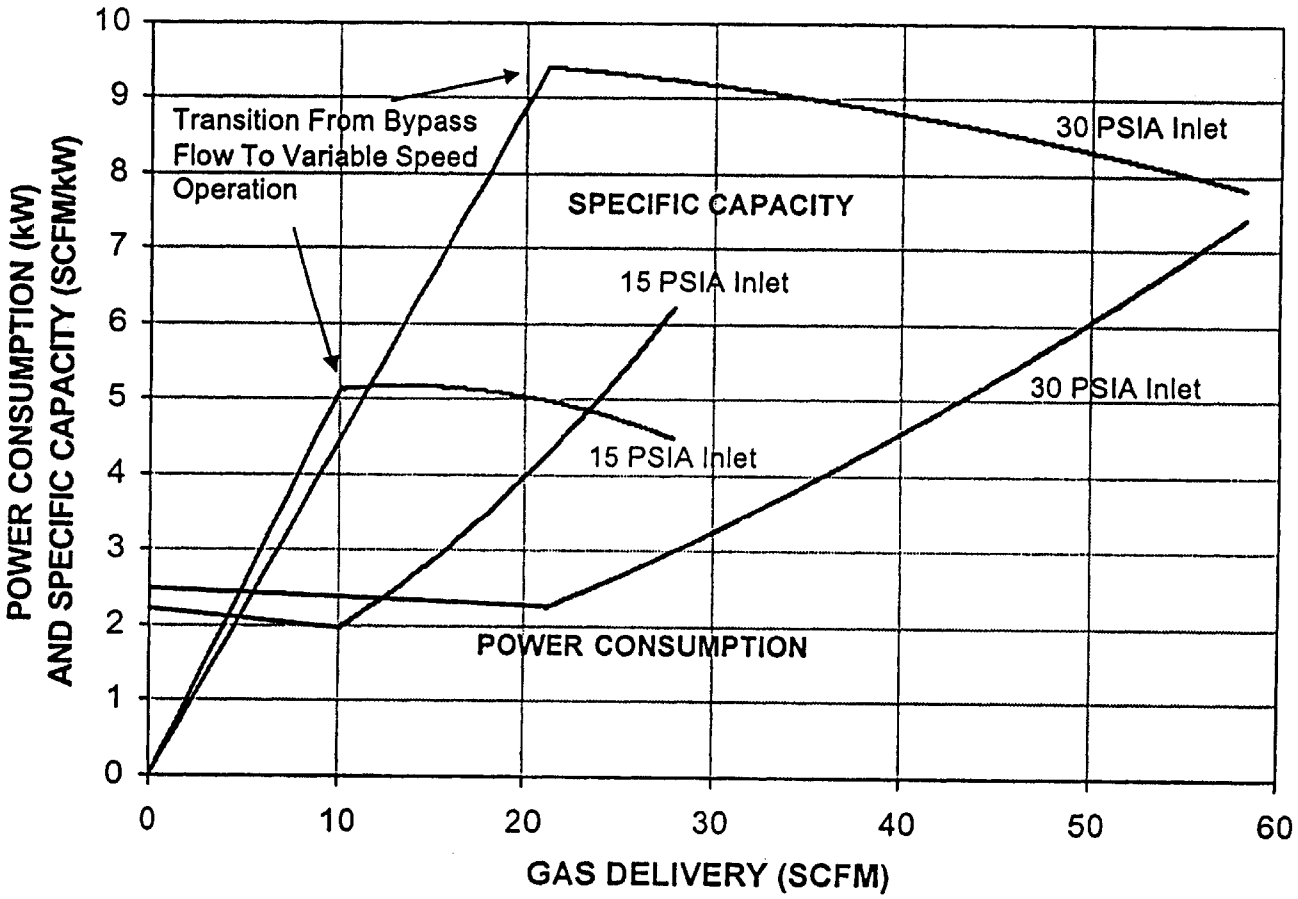
Figure 1:
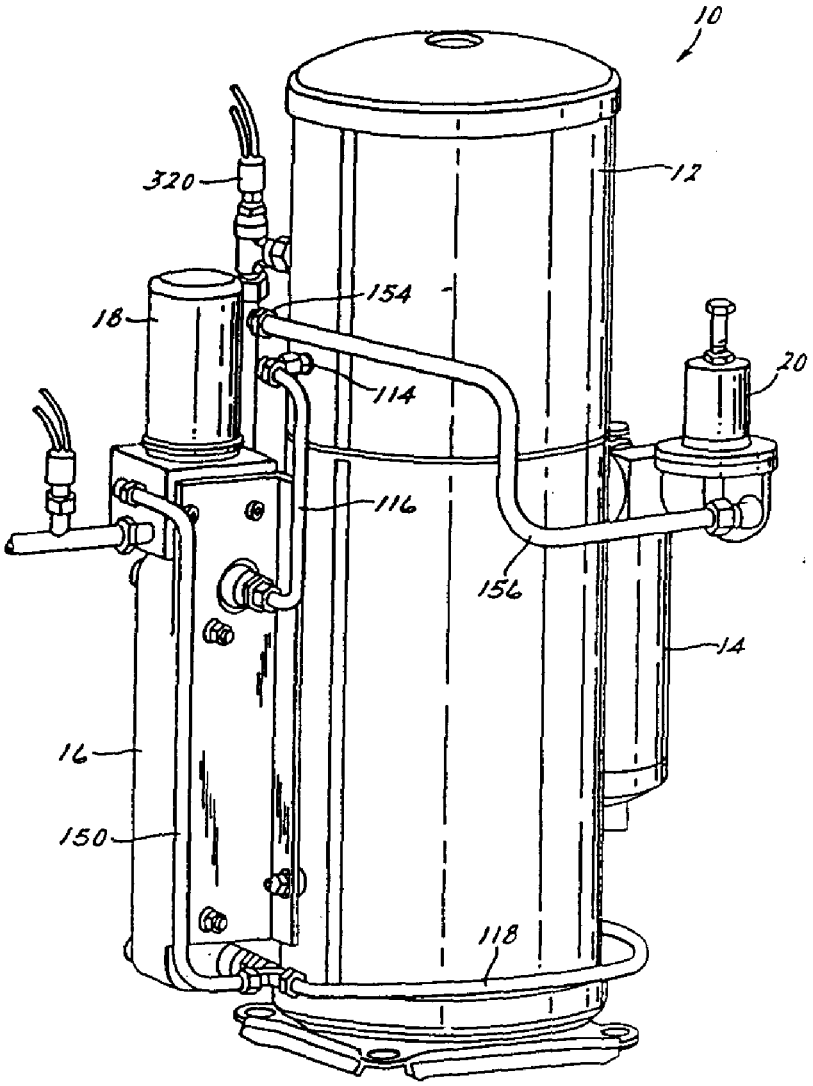
Figure 2:
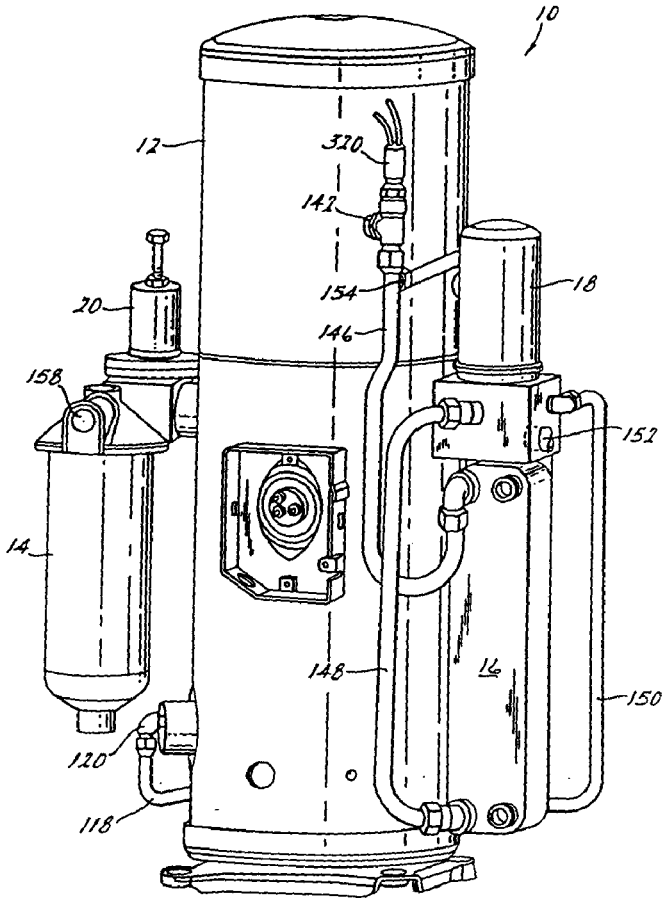
Figure 3:
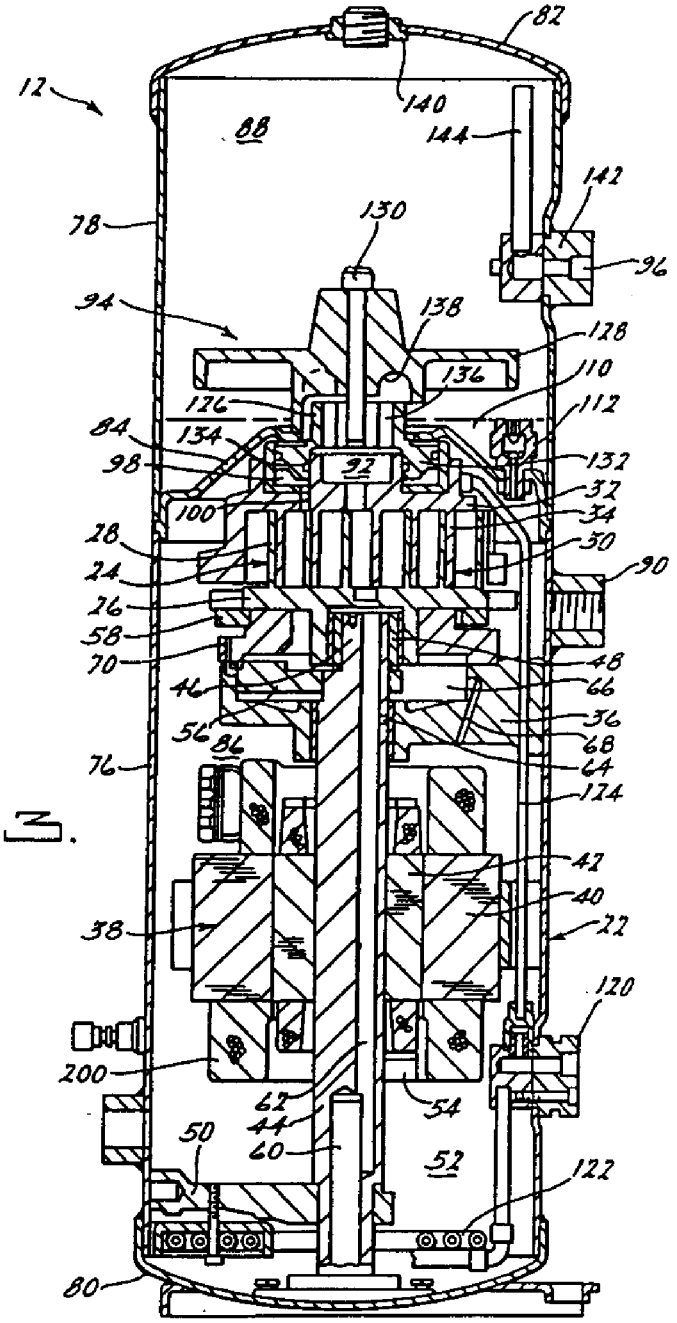
Figures 4, 4A:
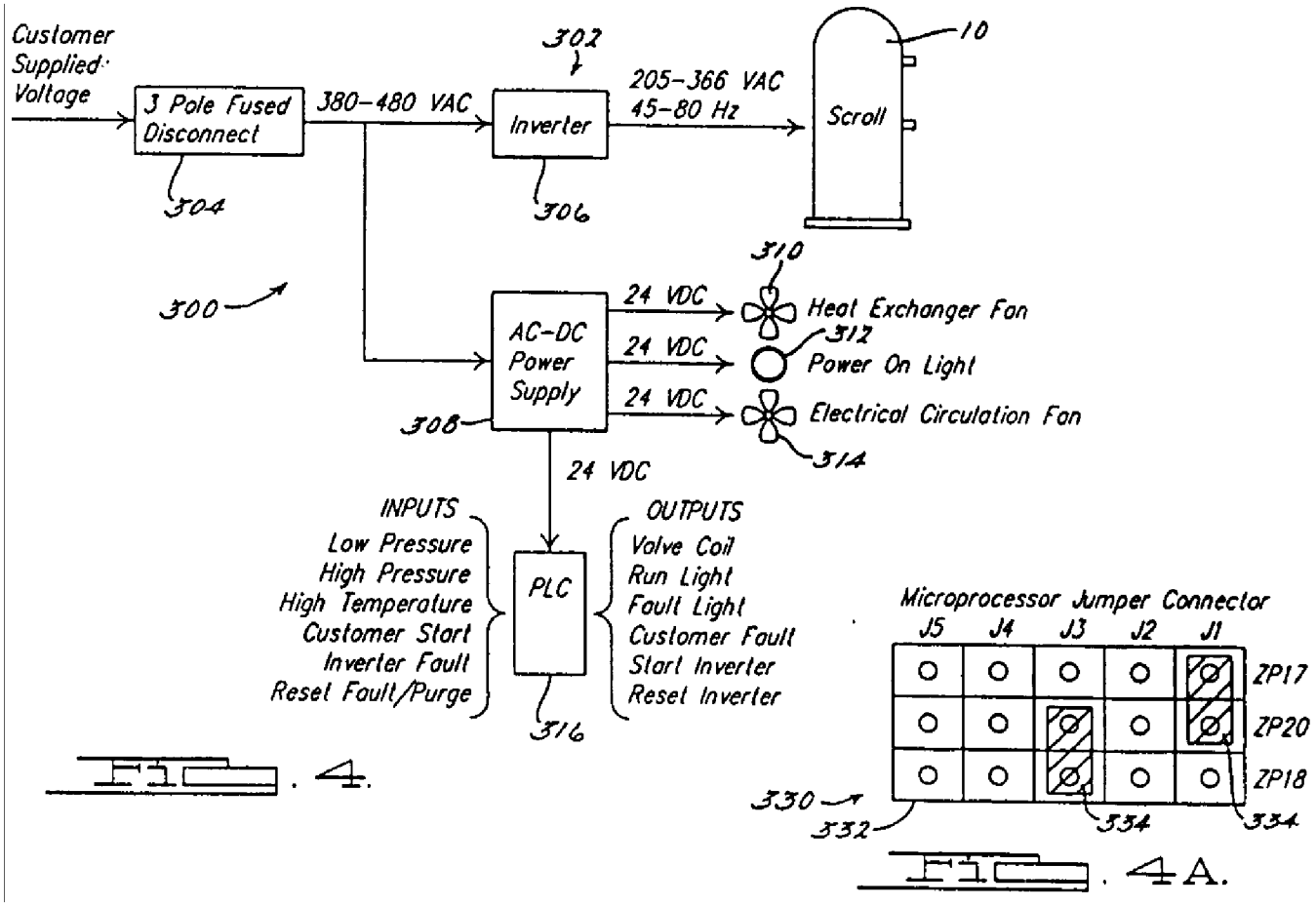
Figure 5:
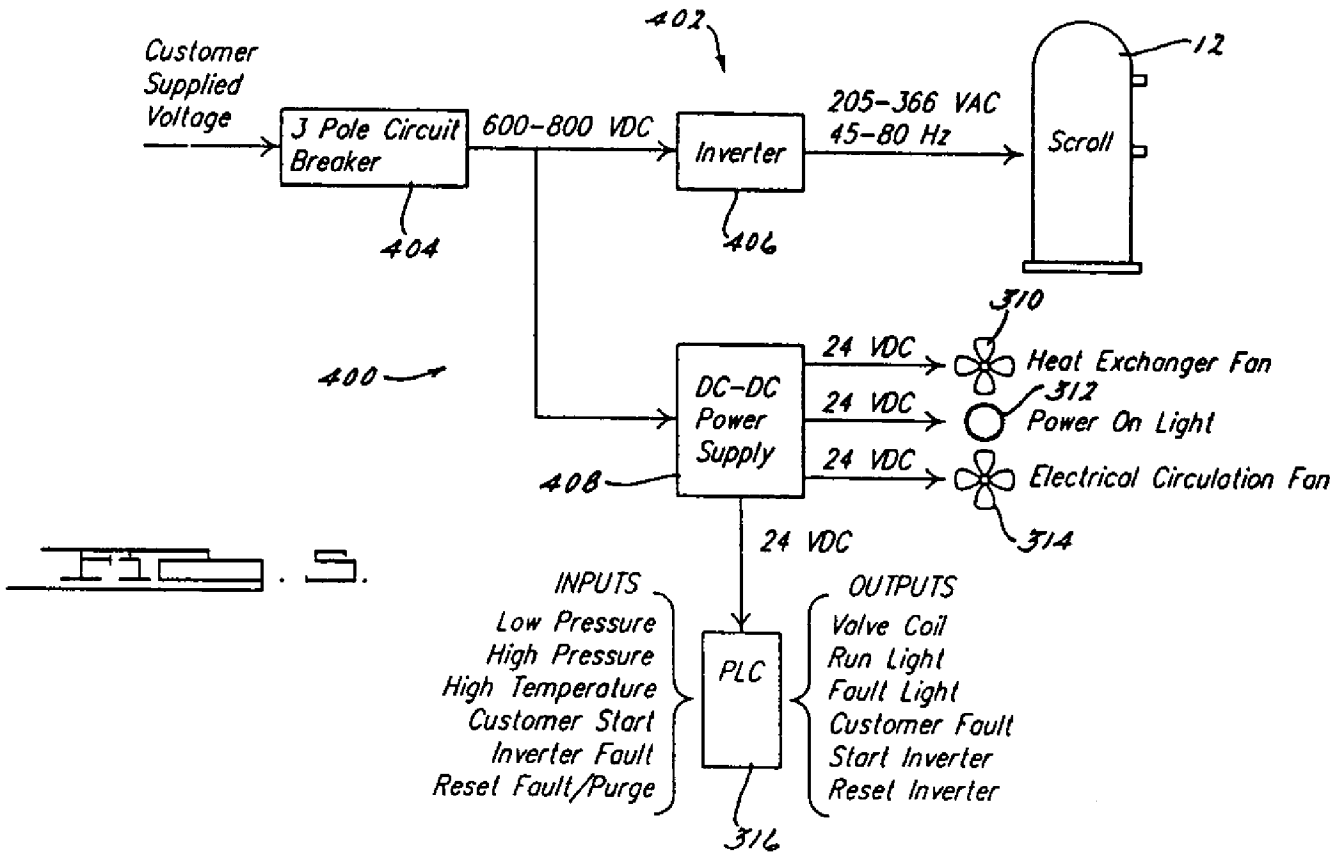

The application spectrum of the fuel gas compressor system 820 requires an electronic control package to satisfy multiple. needs including variable fuel flow, delivery pressure control, system fault sensing and run signal response, and the ability to receive power from either AC or DC power sources. In addition, satisfying regulatory agency requirements in both the U.S. and Europe requires the selection of potentially different electrical components. In prior art designs, these varying needs were met with a number of different build options requiring a variety of special parts. With the present invention, all of the required functions were consolidated into a single integrated electronic module with minimal change required to meet specific model needs. The electronic architecture of gas booster control module 502 is shown in FIG. 12, FIG. 6 and FIG. 7. Two key elements shown in this diagram are input board 506 and inverter board 508. Included in input board 506 are EMC (Electro Magnetic Compatibility) filtering capability, 864 transient protection 866 and three-phase rectification 868 of the supply voltage.

Referring to FIGS. 12 and 7, the EMC filtering 864 is accomplished by device 526 which uses capacitors to reduce the amount of conducted noise put back on the mains, or other AC supply source. Transient protection 866 is accomplished through metal oxide varistors 520 that allow the compressor control module to withstand power surges up to 6 kV. Three-phase rectification 868 is accomplished with three-phase diode module 524. If the power source is AC power, diode module 524 rectifies the three-phase voltage into a DC voltage. If the power source is DC, diode module 524 simply allows it to pass through.

Another versatile feature included in the input board design is the dual AC or DC capability of the input power supply. Jumper card 510 is removed for DC power and left in place for AC power input. Jumper card 510 keeps filtering capacitors 522 and transient overvoltage protection present in the circuit. When jumper card 510 is removed, those components do not function. The filtering and transient protection is not necessary in a DC power application because the power generator supplying the DC power provides this protection.

The heart of the compressor control module is inverter board 508. Key features include DSP (digital signal processor) based motor control 514, DC to DC power supply 516 and microprocessor based logic control 518 for monitoring input fault signals, a customer run signal and a pressure transducer feedback control signal.

Motor controller 514 function is realized by using the DC voltage supplied by input board 506 to create a sinusoidal AC voltage delivered to the motor. The DSP controls an insulated gate bipolar transistor module that switches the DC voltage in a PWM (pulse width modulation) control scheme. The resulting waveform looks like a sinusoidal AC voltage to the compressor induction motor. Using this technique allows the DSP to vary the frequency and voltage to the compressor motor, thereby controlling its speed.

DC to DC power supply utilizes 300 VDC on the board, and through a switch mode power supply circuit, provides 24, 18 and 5 VDC for device power and logic signals.

Microprocessor logic control 518 controls the LED's on the customer interface board and communicates compressor faults when abnormal operation occurs. Some examples of system induced fault modes are bypass valve failure causing high pressure, low oil level causing high temperature, and undersized inlet piping causing inlet pressure to fall below USDOT regulated levels. In addition, microprocessor logic control 518 reads the pressure transducer signal that is run through a proportional/integral loop. The resulting error is used to calculate a speed command send to DSP motor control 514.

A customer Interface board consists of LED's which indicate low inlet pressure, high outlet pressure, high oil temperature, high motor current, motor controller fault and fan controller fault.

Oil and gas cooling is accomplished through air cooled heat exchangers 834 and 848 that utilize a fractional horsepower, single phase AC fan motor. The fan controller board converts 300 VDC to 230 VAC to power this fan motor. The fan motor controller uses the same PWM technique explained earlier for the inverter board. The fan motor controller is designed to operate at a specific temperature. Jumper board system 330, FIG. 4A, is utilized to program this specific temperature. The specific temperature is programmed by placing jumper 334 between position J1 in the upper row (ZP17) and position J1 in the middle row (ZP20). While the use of only one jumper 334 for programming the specific temperature allows the selection between two temperature settings, additional jumper locations can be incorporated if additional temperature settings are required. In the preferred embodiment, absence of jumper 334 programs the system for biogas and the addition of jumper 334 programs the system for natural gas. In FIG. 4A, the system is programmed for natural gas and will thus control the heat exchanger fans to maintain the specified temperature for the compressed fuel gas. The temperature setting capability for jumper board system 330 can be utilized in any of the embodiments detailed above.

Several additional capabilities of control module 502 are a broad operating temperature range and the ability to couple together multiple fuel gas compressors in a multi-pack arrangement. The customer electronic design allows the use of components capable of broader ambient temperature operation than with standard components. To accommodate both high and low ambient applications, all electronic components have been selected to operate from −40° F. to 120° F.

When multiple compressors are needed to supply one or more power generation device, the units are operated in a master/slave arrangement where only one unit (master) operates using its pressure transducer feedback signal to maintain outlet pressure. The other units (slaves) operate at the same frequency as the master using an analog signal broadcast by the master to all slaves. Conversion from master to slave duty is accomplished, in this design with a simple jumper wire as is well known in the art.

The performance of a fuel gas booster compressor is similar to that of an air compressor with output being measured in gas volume flow scfm (standard $ft^3$/min) or equivalent, and input being measured in electrical power kw (kilowatts). Specific capacity, characterized by output divided by input, is then defined by scfm/kw. For specific fuels such as natural gas, the output parameter can be stated in mass flow by multiplying the scfm of the compressor by the density of the fuel. However, for the purpose of product comparison, it is best to use scfm as the baseline output parameter. By definition, scfm is the gas flow at standard conditions, usually 14.7 psia and 60° F. for natural gas products. With a variable speed or variable flow machine, it is helpful to characterize operating performance in a single chart that indicates product performance over the entire range of flow. One method of characterizing both output and input parameters as a function of variable flow is shown in FIG. 13.

Two sets of data are shown here to demonstrate performance as a function of both minimum and maximum inlet pressures. Delivery pressure in this chart is set at a typical level of 85 psig although actual use pressures may vary from 60 to 100 psig. Starting with the specific capacity curve at 15 psia, note that specific capacity increases linearly from zero as the compressor bypass valve closes from full bypass to zero bypass at the minimum operating speed of 30 Hz. In this range, the power generator is in a start up mode where the fuel demand starts at zero and increases gradually. As this is a transient situation, the low specific capacity in this region has minimal effect on overall operating performance of the fuel delivery system. When more flow is required than can be supplied at the minimum operating speed (30 Hz), the electronic variable speed drive takes control and peak performance follows.

Specific capacity is highest in the low frequency range and decreases with increasing frequency due to relatively high power from both viscous drag forces in the compressor, and higher flow losses in both the inlet and outlet components. As a function of inlet pressure, specific capacity is highest at high inlet pressure due to the higher theoretical efficiency obtained at lower operating pressure ratios (3.3 versus 6.6) for the compressor. Theoretical performance, as measured by isentropic efficiency, is nearly-constant with inlet pressure: 49% at 15 psia and 47% at 30 psia. This efficiency is comparable to refrigeration scroll compressors and other gas compressors, but well below the 70% attainable with high efficiency air conditioning scroll compressors. The difference in efficiency is due to the relatively high mechanical losses (as a percent of overall power) of the low-pressure gas compressor, the significant heating of the gas entering the scrolls above the 60° F. inlet condition, and the pressure losses of the system that are not included in typical compressor performance data. Without the inclusion of system pressure losses, the isentropic efficiency at the two respective inlet pressures becomes 53% and 58%. Overall, the efficiency of the fuel gas booster system is very good relative to other gas compression technologies, particularly when efficiency over a broad gas flow range is taken into account. Specifically, for compressor systems using outlet gas bypassing (or inlet throttling) as the primary means of flow control, efficiency is very low relative to the nearly uniform efficiency obtained with a variable speed drive.

In addition to long life and efficient operation, low sound and vibration is a desirable attribute for a fuel gas compression product. Due to the scroll compression technology used with this design, compressor noise is very low relative to adjacent power generation equipment. Typically the sound level of the fuel gas booster is 6 or more dBA less than the generator or 25% of the sound power. Measured sound levels are 75 dBA sound pressure level at one meter, or 83 dBA sound power level. Vibration level is also very important in gas appliance due to the correlation of high vibration with potential gas leakage. With scroll compressor technology, nearly perfect dynamic balance is achieved and low vibration levels of less than 0.003 inch are obtained. The net result is a product that runs quietly with no noticeable vibration relative to the adjacent power generator.

The present invention described above was developed and tested primarily for pipeline quality natural gas compression. For this application, as detailed above, chemical resistance of the compressor to hydrogen sulfide and other non-methane components required a special aluminum wound hermetic motor in place of the normal copper wound motor. Also, a polyalphaolefin lubricant which chemical pacifiers was selected to provide extra protection against corrosion of metallic surfaces. These modifications provided a basic level of protection for pipeline applicants but also served to prepare the product for other non-pipeline applications.

While the above detailed description describes the preferred embodiment of the present invention, it should be understood that the present invention is susceptible to modification, variation and alteration without deviating from the scope and fair meaning of the subjoined claims.

What is claimed is:

1. A compressor system comprising:

a compressor;

an electric motor drivingly connected to said compressor;

a source of electrical power;

a control system disposed between said source of electrical power and said electric motor, said control system operable to provide transfer power from said source of electrical power to said electric motor, said control system including a jumper movable between a first position when said source of electrical power is an alternating current power source and a second position when said source of electrical power is a direct current power source, said jumper controlling the power input to said control system from said source of electrical power.

2. The compressor system according to claim 1 wherein said control system includes an inverter board in communication with said electric motor, said inverter board operable to supply alternating current to said electric motor.

3. The compressor system according to claim 1 wherein said electric motor is a variable speed motor, said control system including a motor controller for varying the speed of said motor.

4. The compressor system according to claim 1 wherein said control system includes a programmable logic control system, said programmable logic control system being in communication with a sensor which monitors an operating characteristic of said compressor.

5. The compressor system according to claim 4 wherein said sensor is a pressure sensor and said operating characteristic is discharge pressure of said compressor system.

6. The compressor system according to claim 4 wherein said programmable logic control includes a jumper board system for programming a pressure set point for comparison with said discharge pressure.

7. The compressor system according to claim 1 further comprising a heat exchanger fan, said control system including a fan controller board for operating said heat exchanger fan when a specified discharge temperature is reached.

8. The compressor system according to claim 7 wherein said control system includes a jumper board system for programming said specified discharge temperature.

9. The compressor system according to claim 1 wherein said control system includes a DC-DC power supply, said DC-DC power supply being in communication with said fan controller board.

10. The compressor system according to claim 1 wherein said control system includes a programmable logic control system, said programmable logic control system providing an output signal indicating the status of said compressor.

11. The compressor system according to claim 1 wherein said compressor is a scroll compressor.

12. A fuel gas compression system comprising:

a compressor for compressing fuel gas from a suction pressure to a discharge pressure selected from one of a plurality of preset discharge pressures;

a variable speed electric motor drivingly connected to said compressor;

a control system in communication with said electric motor and said compressor, said control system maintaining one of said plurality of discharge pressures by varying the speed of said variable speed electric motor; and a jumper board system for selecting said one of said plurality of discharge pressures.

13. The fuel gas compression system according to claim 12 wherein said control system includes a temperature sensor for monitoring a temperature of said fuel gas at said discharge pressure.

14. The fuel gas compression system according to claim 13 wherein said jumper board system is operable to program a specified temperature for said fuel gas at said discharge pressure.

* * * * *

UNITED STATES PATENT AND TRADEMARK OFFICE

CERTIFICATE OF CORRECTION

PATENT NO. : 6,616,415 B1 
DATED : September 9, 2003
INVENTOR(S) : Troy W. Renken and Phill Langhorst It is certified that error appears in the above-identified patent and that said Letters Patent is hereby corrected as shown below:

Title page,
Showing an illustrative figure should be deleted and substitute therefore the attached title page.

Drawings,
Delete sheet(s) 1-13, and substitute therefore the drawing sheets(s) consisting of Figs 1-13 as shown on the attached pages.

Column 5,
Line 13, after "shell" (first occurrence), delete "piece".
Line 16, "sealing" should be -- sealingly --.

Column 6,
Lines 8 and 12, after "120" insert -- . --.
Line 33, after "128" insert -- . --.
Line 47, "146" should be -- 140 --.

Column 9,
Line 25, "jet" should be -- set --.
Line 62, "advantage" should be -- advantages --.

Column 10,
Line 20, after "signal" insert -- , --.

Column 12,
Line 39, "516" should be -- 518 --.

Column 14,
Line 1, "read valve" should be -- reed valve --.
Line 33, "compression" should be -- compressor --.

Column 15,
Line 31, "them" should be -- then --.
Line 43, "ration" should be -- ratio --.
Line 58, after "830" insert -- ) --.

Column 16,
Line 29, after "multiple" delete ".".
Line 44, "capability, 864" should be -- capability 864, --.

UNITED STATES PATENT AND TRADEMARK OFFICE

CERTIFICATE OF CORRECTION

PATENT NO. : 6,616,415 B1
DATED : September 9, 2003
INVENTOR(S) : Troy W. Renken and Phill Langhorst It is certified that error appears in the above-identified patent and that said Letters Patent is hereby corrected as shown below:

Column 17,
Line 30, "Interface" should be -- interface --.

Column 19,
Line 41, after "to" delete "provide".

Signed and Sealed this

Thirty-first Day of August, 2004

JON W. DUDAS
*Director of the United States Patent and Trademark Office*

(12) United States Patent
Renken et al.

(10) Patent No.: US 6,616,415 B1
(45) Date of Patent: Sep. 9, 2003

(54) FUEL GAS COMPRESSION SYSTEM

(75) Inventors: Troy W. Renken, Troy, OH (US); Phil Langhorst, Crestwood, MO (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 10/106,652

(22) Filed: Mar. 26, 2002

(51) Int. Cl.[7] ..... F04B 49/06
(52) U.S. Cl. ..... 417/44.1; 318/433
(58) Field of Search ..... 417/26, 44.1; 60/277, 60/676; 62/228, 210; 290/52; 318/803, 433; 307/10.6; 388/934; 236/10

(56) References Cited

U.S. PATENT DOCUMENTS 4,353,220 A * 10/1982 Curwen et al. ..... 62/228
4,421,268 A * 12/1983 Bassett et al. ..... 236/10
5,123,080 A * 6/1992 Gillett et al. ..... 388/934
5,125,067 A * 6/1992 Erdman ..... 388/934
5,126,642 A * 6/1992 Shahrodi ..... 318/433
5,272,428 A * 12/1993 Spiegel et al. ..... 318/803
5,272,879 A * 12/1993 Wiggs ..... 60/676
5,765,380 A * 6/1998 Misawa et al. ..... 62/210
6,066,898 A * 5/2000 Jensen ..... 290/52
6,198,174 B1 * 3/2001 Nims et al. ..... 290/52
6,396,165 B1 * 5/2002 Nagano et al. ..... 307/10.6
6,461,112 B1 * 10/2002 Ohta et al. ..... 417/26
2001/0037642 A1 * 11/2001 Uchida ..... 60/277

* cited by examiner

*Primary Examiner*—Teresa Walberg
*Assistant Examiner*—L Fastovsky
(74) *Attorney, Agent, or Firm*—Harness, Dickey & Pierce, P.L.C.

(57) ABSTRACT

A fuel gas compression system includes a system which operates on direct current, a system which operates on alternating current and a system which is capable of operating on either direct current or alternating current. In the system that operates on either direct current or alternating current, a jumper is provided which is placed in the circuit when an alternating current is provided. When a direct current is provided, the jumper is removed from the circuit.

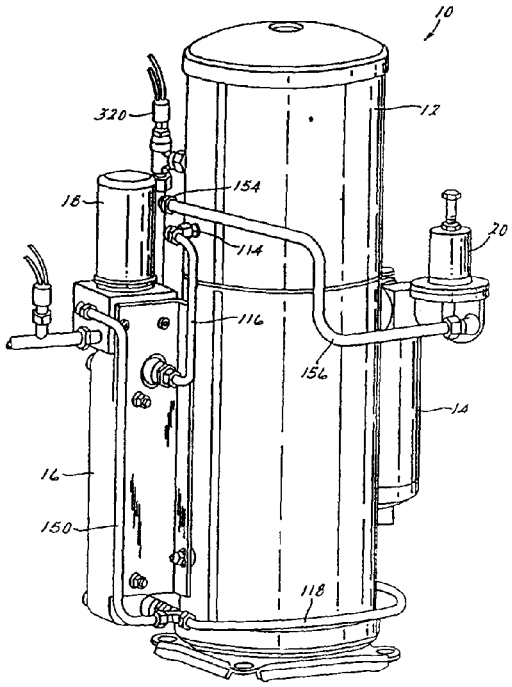

14 Claims, 13 Drawing Sheets